US010455342B2

(12) United States Patent
Kim et al.

(10) Patent No.: US 10,455,342 B2
(45) Date of Patent: Oct. 22, 2019

(54) SOUND EVENT DETECTING APPARATUS AND OPERATION METHOD THEREOF

(71) Applicant: SAMSUNG ELECTRONICS CO., LTD., Suwon-si (KR)

(72) Inventors: Jin-sung Kim, Seoul (KR); Jae-hoon Jeong, Suwon-si (KR); Jung-eun Park, Gwacheon-si (KR); Ki-wan Eom, Hwaseong-si (KR); Byeong-seob Ko, Suwon-si (KR); Anant Baijal, Suwon-si (KR); In-woo Hwang, Incheon (KR); Sang-chul Ko, Seoul (KR); Jeong-su Kim, Yongin-si (KR); Seung-yeol Lee, Seoul (KR); Jae-youn Cho, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 120 days.

(21) Appl. No.: 14/896,534

(22) PCT Filed: Jun. 5, 2014

(86) PCT No.: PCT/KR2014/005024

§ 371 (c)(1),
(2) Date: Jan. 28, 2016

(87) PCT Pub. No.: WO2014/196836

PCT Pub. Date: Dec. 11, 2014

(65) Prior Publication Data

US 2016/0150338 A1 May 26, 2016

Related U.S. Application Data

(60) Provisional application No. 61/831,310, filed on Jun. 5, 2013.

(30) Foreign Application Priority Data

Nov. 26, 2013 (KR) ..... 10-2013-0144923

(51) Int. Cl.
*H04R 29/00* (2006.01)
*G10L 25/18* (2013.01)
*G10L 25/72* (2013.01)

(52) U.S. Cl.
CPC ..... *H04R 29/008* (2013.01); *G10L 25/18* (2013.01); *G10L 25/72* (2013.01); *H04R 29/004* (2013.01)

(58) Field of Classification Search
CPC ..... H04R 1/1041; H04R 1/1083; H04R 2201/003; H04R 2420/07; H04R 25/554;
(Continued)

(56) References Cited

U.S. PATENT DOCUMENTS 7,356,473 B2 4/2008 Kates
7,567,676 B2 7/2009 Griesinger
(Continued)

FOREIGN PATENT DOCUMENTS

CN 1830009 A * 9/2006 ..... G01S 3/8083
CN 1830009 A 9/2006
(Continued)

OTHER PUBLICATIONS

Okada, et al.; "Sound Information Notification System by Two-Channel Electrotactile Stimulation for Hearing Impaired Persons", Proceedings of the 29th Annual International Conference of the IEEE EMBS, Aug. 2007, XP031337045, 4 pages total.
(Continued)

*Primary Examiner* — Akelaw Teshale
(74) *Attorney, Agent, or Firm* — Sughrue Mion, PLLC

(57) ABSTRACT

Provided is a method of operating an acoustic event detecting apparatus including: receiving an acoustic input; extract-
(Continued)

ing frequency characteristics of the acoustic input; determining whether a first acoustic event has occurred by analyzing the extracted frequency characteristics; and in response to determining that the first acoustic event has occurred, acquiring data about at least one of a sound, an image, and a video from an environment outside of the acoustic event detecting apparatus and transmitting the data to a first device.

9 Claims, 24 Drawing Sheets

(58) Field of Classification Search
CPC ..... H04R 29/004; H04R 3/005; H04R 19/04; H04R 1/028; H04R 1/04; H04R 1/10; H04R 1/105; H04R 2225/31; H04R 2225/67; H04R 2430/20; H04R 2460/03; H04R 2460/15; H04R 29/008; H04R 2499/13; H04R 25/30; H04R 25/305; H04R 25/43; H04R 25/558; H04R 25/602; H04R 25/604; H04R 25/606; H04R 29/001; H04R 3/12; H04R 5/033; G10L 25/18; G10L 25/78; G08B 21/0208; G08B 1/08; G08B 13/1672
USPC ..... 381/58
See application file for complete search history.

(56) References Cited

U.S. PATENT DOCUMENTS

| | | | | |
|---|---|---|---|---|
| 8,918,343 | B2 * | 12/2014 | Mitchell | G10L 17/26 706/12 |
| 2004/0005064 | A1 * | 1/2004 | Griesinger | G01S 3/8083 381/17 |
| 2006/0155465 | A1 | 7/2006 | Jung et al. | |
| 2007/0281761 | A1 | 12/2007 | Kim | |
| 2009/0074304 | A1 * | 3/2009 | Momosaki | G06K 9/00268 382/224 |
| 2009/0089712 | A1 * | 4/2009 | Sato | G06F 3/0482 715/838 |
| 2009/0170532 | A1 * | 7/2009 | Lee | H04M 1/72566 455/456.3 |
| 2010/0074590 | A1 * | 3/2010 | Momosaki | G11B 27/034 386/278 |
| 2010/0104145 | A1 * | 4/2010 | Momosaki | G06K 9/00295 382/118 |
| 2011/0087079 | A1 * | 4/2011 | Aarts | A61B 7/003 600/300 |
| 2011/0313555 | A1 * | 12/2011 | Shoham | G10L 25/48 700/94 |
| 2013/0070104 | A1 * | 3/2013 | Hu | H04N 5/232 348/169 |

FOREIGN PATENT DOCUMENTS

| | | | |
|---|---|---|---|
| CN | 101124617 | A | 2/2008 |
| CN | 101202992 | A | 6/2008 |
| CN | 102088911 | A | 6/2011 |
| JP | 3031588 | U | 11/1996 |
| JP | 2001-307238 | A | 11/2001 |
| JP | 2003-99881 | A | 4/2003 |
| JP | 2003099881 | A * | 4/2003 |
| JP | 2003-219061 | A | 7/2003 |
| JP | 3905769 | B2 | 4/2007 |
| JP | 2007-267196 | A | 10/2007 |
| JP | 2008-197879 | A | 8/2008 |
| KR | 1999-002147 | A | 1/1999 |
| KR | 1999-0083808 | A | 12/1999 |
| KR | 10-2006-0030665 | A | 4/2006 |
| KR | 10-2006-0095346 | A | 8/2006 |
| KR | 10-0691992 | B1 | 3/2007 |
| KR | 10-2007-0039283 | A | 4/2007 |
| KR | 10-0744301 | B1 | 7/2007 |
| KR | 10-2008-0035549 | A | 4/2008 |
| KR | 10-2008-0075586 | A | 8/2008 |
| KR | 10-2011-0057525 | A | 6/2011 |
| KR | 10-2014-0143069 | A | 12/2014 |
| WO | 00/75899 | A1 | 12/2000 |
| WO | 2006/078401 | A1 | 7/2006 |

OTHER PUBLICATIONS

Communication dated Feb. 13, 2017, issued by the European Patent Office in counterpart European Application No. 14807903.1.
Communication dated Sep. 5, 2014 issued by the Int. Searching Authority in counterpart Application No. PCT/KR2014/005024 (PCT/ISA/210).
Communication dated Sep. 5, 2014 issued by the Int. Searching Authority in counterpart Application No. PCT/KR2014/005024 (PCT/ISA/237).
Communication dated Apr. 4, 2018, issued by the Chinese Patent Office in counterpart Chinese Application No. 201480044845.9.
Communication dated Jan. 19, 2019 issued by the Indian Intellectual Property Office in Indian counterpart Application No. 201627000179.
Communication dated Dec. 21, 2018 by the State Intellectual Property Office of P.R. China in counterpart Chinese Application No. 201480044845.9.
Communication dated Jun. 18, 2019, issued by the Korean Intellectual Property Office in counterpart Korean Application No. 10-2013-0144923.
Communication dated Jul. 8, 2019 issued by the State Intellectual Property Office of P.R. China in counterpart Chinese Application No. 201480044845.9.

* cited by examiner

SOUND EVENT DETECTING APPARATUS AND OPERATION METHOD THEREOF

TECHNICAL FIELD

The inventive concept relates to an acoustic event detecting apparatus and a method of operating the apparatus, and more particularly, to an apparatus and method of performing various operations based on detected acoustic events by analyzing acoustic inputs so as to provide users with convenience in everyday life.

BACKGROUND ART

Research into a technology of detecting and classifying acoustic events has been conducted to be used for the determination of a peripheral environment of a user by being combined with a context-aware technology.

Generally, in the related art, a technology of measuring an intensity of an acoustic input and performing a predetermined operation in a case where the intensity of the acoustic event is greater than or equal to a threshold value has been used. However, when simply determining whether an acoustic event occurs by using the intensity of the acoustic input, it is difficult to perform operations suitable for each of a plurality of acoustic events when the plurality of acoustic events occur.

DETAILED DESCRIPTION OF THE INVENTIVE CONCEPT

Technical Problem

The inventive concept provides an acoustic event detecting apparatus capable of recognizing peripheral environment based on acoustic events that are detected by analyzing acoustic inputs in order to perform operations corresponding to the acoustic events and the peripheral environment, and a method of operating the acoustic event detecting apparatus.

Technical Solution

One or more exemplary embodiments provide an acoustic event detecting apparatus capable of recognizing a peripheral status based on a detected acoustic event by analyzing an acoustic input and performing an operation corresponding to the acoustic event and the peripheral status, and a method of operating the apparatus.

According to an aspect of an exemplary embodiment, there is provided a method of operating an acoustic event detecting apparatus, the method including: extracting frequency characteristics of an acoustic input; determining whether a first acoustic event has occurred by analyzing the extracted frequency characteristics; in response to determining that the first acoustic event has occurred, acquiring data about at least one of a sound, an image, and a video from an environment outside of the acoustic event detecting apparatus; and transmitting the data to a first device.

The determining whether the first acoustic event has occurred may include: calculating a plurality of similarity values between the extracted frequency characteristics and a plurality of acoustic models respectively corresponding to a plurality of acoustic events; selecting an acoustic event corresponding to a highest similarity value among the calculated plurality of similarity values from among the plurality of acoustic events; and in response to the selected acoustic event being the first acoustic event, determining that the first acoustic event has occurred.

The method may further include transmitting, to a second device, a control signal for controlling the second device, in response to determining that the first acoustic event has occurred.

The first device and the second device may respectively include at least one of a home electronic appliance, a portable terminal, and a gas or power disconnecting device.

The method may further include receiving from the first device and outputting at least one of a sound, an image, and a video, in response to determining that the first acoustic event has occurred.

According to an aspect of an exemplary embodiment, there is provided an acoustic event detecting apparatus including: a receiver configured to receive an acoustic input; a sound processor configured to extract frequency characteristics of the acoustic input and determine whether a first acoustic event has occurred by analyzing the extracted frequency characteristics; a data acquirer configured to acquire data about at least one of a sound, an image, and a video from an environment outside of the acoustic event detecting apparatus, in response to determining that the first acoustic event has occurred; and a communicator configured to transmit the data to a first device.

The sound processor may be further configured to calculate a plurality of similarity values between the extracted frequency characteristics and a plurality of acoustic models respectively corresponding to a plurality of acoustic events, select an acoustic event having a highest similarity value among the calculated plurality of similarity values from among the plurality of acoustic events, and determine that the first acoustic event has occurred in response to the selected acoustic event being the first acoustic event.

The communicator may be further configured to transmit a control signal for controlling a second device to the second device, in response to determining that the first acoustic event has occurred.

The first device and the second device may respectively include at least one of a home electronic appliance, a portable terminal, and a gas or power disconnecting device.

The acoustic event detecting apparatus may further include an outputter configured to output at least one of a sound, an image, and a video transmitted from the first device, in response to determining that the first acoustic event has occurred.

According to an aspect of an exemplary embodiment, there is provided a method of operating an acoustic event detecting apparatus, the method including: extracting frequency characteristics of an acoustic input; determining whether a first acoustic event has occurred by analyzing the frequency characteristics; and performing an operation corresponding to the first acoustic event in response to determining that the first acoustic event has occurred, wherein the operation corresponding to the first acoustic event includes at least one of displaying a first standby screen for stopping an operation of notifying an emergency state, acquiring a keyword that is mapped with the first acoustic event and stored, setting a notification mode corresponding to the first acoustic event, and displaying a second standby screen for initiating communication with a predetermined external device.

The method may further include, in response to displaying the first standby screen, transmitting a message representing the emergency state to the predetermined external device unless an input for stopping the operation of notifying the emergency state is received from a user within a predetermined time after displaying the first standby screen, and wherein the first standby screen may be set by the user.

The method may further include, in response to the acquiring the keyword that being mapped with the first acoustic event and stored, acquiring information related to the keyword from a storage of the acoustic event detecting apparatus or from an external server and outputting the information.

The setting the notification mode corresponding to the first acoustic event may include setting the notification mode to be at least one of a bell ringing mode, a vibration mode, and a mute mode.

According to an aspect of an exemplary embodiment, there is provided an acoustic event detecting apparatus including: a receiver configured to receive an acoustic input; a sound processor configured to determine whether a first acoustic event has occurred by extracting a frequency characteristic of the acoustic input and analyzing the extracted frequency characteristic; and an operation controller configured to perform an operation corresponding to the first acoustic event, in response to determining that the first acoustic event has occurred, wherein the operation includes at least one of displaying a first standby screen for stopping an operation of notifying an emergency state, acquiring a keyword that is mapped with the first acoustic event and stored, setting a notification mode corresponding to the first acoustic event, and displaying a second standby screen for initiating communication with an predetermined external device.

The operation controller may be further configured to, in response to displaying the first standby screen, transmit a message representing the emergency state to the predetermined external device unless an input for stopping the operation of notifying the emergency state is received from a user within a predetermined time after displaying the first standby screen, and wherein the first standby screen may be set by the user.

The operation controller may be further configured to, in response to the keyword that being mapped with the first acoustic event and stored, acquire information related to the keyword from a storage of the acoustic event detecting apparatus or from an external server and output the information.

The setting notification mode corresponding to the first acoustic event may include setting the notification mode to be at least one of a bell ringing mode, a vibration mode, and a mute mode.

According to an aspect of an exemplary embodiment, there is provided a method of operating an acoustic event detecting apparatus, the method including: extracting frequency characteristics of an acoustic input; determining whether a first acoustic event has occurred by analyzing the extracted frequency characteristics; and in response to determining that the first acoustic event has occurred, notifying a user of the acoustic event detecting apparatus that the first acoustic event has occurred using a notification method that is determined based on at least one of a duration time of the first acoustic event, an intensity of the acoustic input, a frequency of the first acoustic event during a predetermined time period, and a generation period of the first acoustic event.

The notifying the user that the first acoustic event has occurred may include: in response to determining that the first acoustic event has occurred, notifying the user that the first acoustic event has occurred using a first notification method of a plurality of notification methods to which a plurality of ranks are allocated; and notifying the user that the first acoustic event has occurred using the first notification method and a notification method that is at a next rank as compared to a rank of the first notification method of the plurality of allocated ranks, in response to at least one of a duration time of the first acoustic event continuing for more than a predetermined time, an intensity of the acoustic input increasing, a number of the first acoustic events generated within the predetermined time increasing, and a generation period of the first acoustic event decreasing.

The notifying the user of the first acoustic event may include: in response to determining that the first acoustic event has occurred, notifying the user that the first acoustic event has occurred using a first notification method; in response to the first acoustic event continuing for at least a first time period, notifying the user that the first acoustic event has occurred using the first notification method and a second notification method; and in response to the first acoustic event continuing for at least a second time period, notifying the user that the first acoustic event has occurred using the first notification method, the second notification method, and a third notification method.

The notifying the user of the first acoustic event may include notifying the user that the first acoustic event has occurred by at least one of displaying an image related to the occurrence of the first acoustic event on a screen, generating an emergency alarm or vibration, and stopping execution of an application program that is currently executed.

According to an aspect of an exemplary embodiment, there is provided an acoustic event detecting apparatus including: a receiver configured to receive an acoustic input; a sound processor configured to extract frequency characteristics of the acoustic input and determine whether a first acoustic event has occurred by analyzing the extracted frequency characteristics; and an operation controller configured to, in response to determining that the first acoustic event has occurred, notify the user that the first acoustic event has occurred using a notification method that is determined based on at least one of a duration time of the first acoustic event, an intensity of the acoustic input, a frequency of the first acoustic event during a predetermined time period, and a generation period of the first acoustic event.

The operation controller may be further configured to, in response to determining that the first acoustic event has occurred, notify the user that the first acoustic event has occurred using a first notification method of a plurality of notification methods to which a plurality of ranks are allocated, and notify the user that the first acoustic event has occurred using the first notification method and a notification method that is at a next rank as compared to a rank of the first notification method of the plurality of allocated ranks, in response to at least one of a duration time of the first acoustic event continuing for more than a predetermined time, an intensity of the acoustic input increasing, a number of the first acoustic events generated within the predetermined time increasing, and a generation period of the first acoustic event decreasing.

The operation controller may be further configured to, in response to determining that the first acoustic event has occurred, notify the user that the first acoustic event has occurred using a first notification method, in response to the first acoustic event continuing for a first time period, notify the user that the first acoustic event has occurred using a second notification method, and in response to the first acoustic event continuing for a second time period, notify the user that the first acoustic event has occurred using a third notification method.

The operation controller may be further configured to notify the user that the first acoustic event has occurred by performing at least one of displaying an image related to the occurrence of the first acoustic event on a screen, generating an emergency alarm or vibration, and stopping execution of an application program that is currently executed.

According to an aspect of an exemplary embodiment, there is provided a method of operating an acoustic event detecting apparatus, the method including: extracting frequency characteristics of the acoustic input; detecting an occurrence of an acoustic event related to a type of transportation that the user uses to travel to the destination from the extracted frequency characteristics; recognizing a station by analyzing an announcement announcing the station where the transportation is currently located; calculating an estimated arrival time to the destination based on the acoustic event, the recognized station, and the information about the destination; and notifying the user of the estimated arrival time.

The calculating of the estimated arrival time to the destination may include: determining a location of the acoustic event detecting apparatus based on the acoustic event and the recognized station; and calculating the estimated arrival time to the destination based on the information about the destination and the location of the acoustic event detecting apparatus.

In response to the estimated arrival time being less than a predetermined time, the notifying the user of the estimated arrival time comprises notifying the user that the destination is near using a notification method that is determined based on the estimated arrival time.

According to an aspect of an exemplary embodiment, there is provided an acoustic event detecting apparatus including: a receiver configured to receive information about a destination from a user and an acoustic input; a sound processor configured to extract frequency characteristics of the acoustic input, detect an occurrence of an acoustic event related to a type of a transportation that the user uses to travel to the destination using the extracted frequency characteristics, and recognize a station by analyzing an announcement announcing the station where the transportation is currently located; and an operation controller configured to calculate an estimated arrival time to the destination based on the acoustic event, the recognized station, and the information about the destination, and notify the user of the estimated arrival time.

The operation controller may be further configured to determine a location of the acoustic event detecting apparatus based on the acoustic event and the recognized station, and calculate the estimated arrival time to the destination based on the information about the destination and the location of the acoustic event detecting apparatus.

The operation controller may be further configured to, in response to the estimated arrival time being less than a predetermined time, notify the user that the destination is near using a notification method that is determined based on the estimated arrival time.

According to an aspect of another exemplary embodiment, there is provided a method of operating an acoustic event detecting apparatus, the method including: determining whether a first acoustic event has occurred by analyzing an acoustic input; when it is determined that the first acoustic event has occurred, extracting a characteristic of the acoustic input; and displaying an image representing the characteristic of the acoustic input.

The characteristic of the acoustic input may include at least one of the first acoustic event that is determined to occur based on the acoustic input, a direction of receiving the acoustic input, a magnitude of the acoustic input, and a frequency characteristic of the acoustic input.

According to an aspect of another exemplary embodiment, there is provided an acoustic event detecting apparatus including: a receiver configured to receive an acoustic input; a sound processor configured to determine whether a first acoustic event has occurred by analyzing the acoustic input, and when it is determined that the first acoustic event has occurred, to extract a characteristic of the acoustic input; and an outputter configured to display an image representing the characteristic of the acoustic input.

According to an aspect of another exemplary embodiment, there is provided a computer-readable recording medium having embodied thereon a program, which when executed by a computer, performs the method of operating the acoustic event detecting apparatus.

BEST MODE

Figure 1:
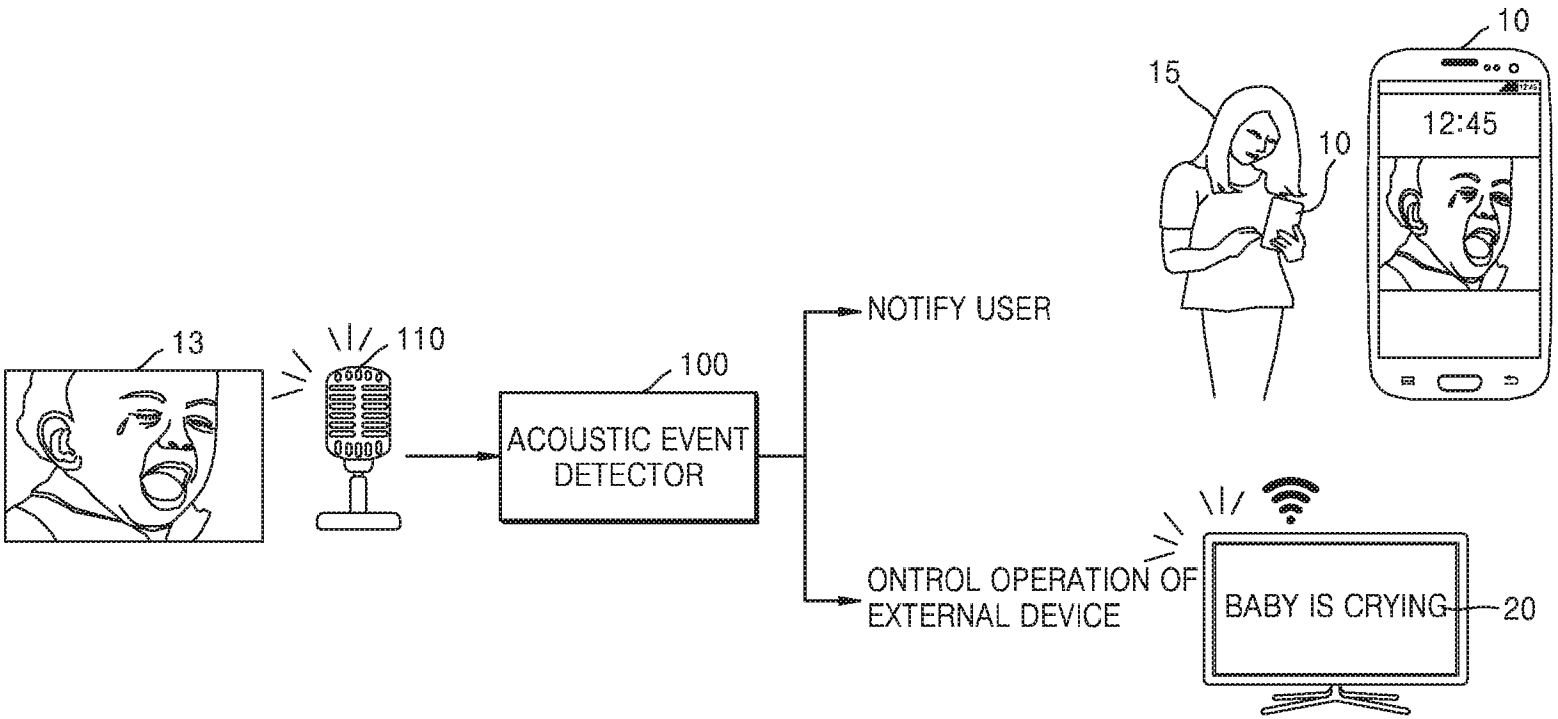
FIG. 1 is a diagram illustrating operations of an acoustic event detecting apparatus according to an exemplary embodiment.

According to an exemplary embodiment, a method of operating an acoustic event detecting apparatus including: receiving an acoustic input; extracting frequency characteristics of the acoustic input; determining whether a first acoustic event has occurred by analyzing the extracted frequency characteristics; and in response to determining that the first acoustic event has occurred, acquiring data about at least one of a sound, an image, and a video from an environment outside of the acoustic event detecting apparatus; and transmitting the data to a first device.

Mode of the Inventive Concept

The attached drawings for illustrating certain exemplary embodiments are referred to in order to gain a sufficient understanding of the exemplary embodiments, the merits thereof, and the objectives accomplished by the implementation of the exemplary embodiments. Hereinafter, the exemplary embodiments will be described in detail with reference to the attached drawings. Like reference numerals in the drawings denote like elements. Expressions such as "at least one of," when preceding a list of elements, modify the entire list of elements and do not modify the individual elements of the list.

Hereinafter, following terms used in the specification will be interpreted in following criteria, and terms that are not recited below may be interpreted according to following intents.

Terms such as ". . . unit", ". . . module", or the like refer to units that perform at least one function or operation, and the units may be implemented as hardware such as FPGA or ASIC, software, or a combination of hardware and software. However, the "unit" is not limited to software or hardware. The "unit" may be configured to exist in a storage medium that is addressable, or may be configured to reproduce one or more processors. Therefore, as an example, the "unit" may include components such as software components, object-oriented software components, class components, and task components, processes, functions, characteristics, procedures, sub-routines, segments of program code, drivers, firmware, micro codes, data, databases, data structures, tables, arrays, and variables. The components and functions provided in the "units" may be combined into a less number of components and "units", or may be divided into additional components and "units".

Also, throughout the present specification, a term "information" may denote meanings such as a value, a parameter, a coefficient, and an element, and may vary depending on the case. However, the exemplary embodiments are not limited thereto.

In addition, an acoustic input may be distinguished from a video input in a broad sense, that is, may denote an input that may be identified by hearing in a broad sense. On the other hand, the acoustic input may be distinguished from a speech input in a narrow sense, that is, may denote an input having less voice characteristic or no voice characteristic. In the present specification, the acoustic input has to be interpreted in the broad sense, but may be appreciated in the narrow sense when it is distinguished from the voice input.

Hereinafter, certain exemplary embodiments will be described below with reference to accompanying drawings.

FIG. 1 is a diagram illustrating operations of an acoustic event detecting apparatus according to an exemplary embodiment.

As shown in FIG. 1, an acoustic event detecting apparatus 100 according to an exemplary embodiment analyzes an acoustic input received through a receiver 110 including a microphone. The acoustic event detecting apparatus 100 may determine whether a predetermined acoustic event occurs by analyzing the acoustic input.

An acoustic event is an event in which a sound is generated. Acoustic events may be classified by at least one of a type of sound source generating the sound and a characteristic of the generated sound. For example, a baby crying and a dog crying have different sound sources from each other, and are distinguished as different acoustic events from each other based on the type of sound source. As another example, a human crying and a human laughing have different sound characteristics, and may be distinguished as different acoustic events from each other based on characteristics of the generated sound. For example, as shown in FIG. 1, the acoustic event detecting apparatus 100 receives an acoustic input including a crying sound generated by a baby 13, and may determine that an acoustic event, that is, a baby is crying, occurs by analyzing the acoustic input.

The acoustic event detecting apparatus 100 according to the present exemplary embodiment may determine which acoustic event occurs by analyzing received acoustic input, and notifies a user of the result of the determination or controls an operation of an external device (for example, a smartphone, a smart TV, a smart watch, etc.) based on the result of the determination.

As shown in FIG. 1, when the acoustic event detecting apparatus 100 determines that an acoustic event, that is, a baby crying, occurs, the acoustic event detecting apparatus 100 may transmit at least one of a sound, an image, or a moving picture of the baby 13 to a portable terminal 10 of a user 15 who may be located in a different area from the baby 13. The user may denote a person receiving a result of detecting an acoustic event from the acoustic event detecting apparatus 100. The result of detecting an acoustic event may include a result of determining whether a predetermined acoustic event occurs or a result of determining which one of a plurality of acoustic events occurs. For example, the user may include at least one of a user of an external device connected to the acoustic event detecting apparatus 100, a policeman, and a guard.

As shown in FIG. 1, when determining that an acoustic event, that is, a baby is crying, occurs, the acoustic event detecting apparatus 100 may transmit a control signal to an external device 20 so that the external device 20 may perform an operation of notifying a user of the occurrence of the acoustic event. For example, as shown in FIG. 1, when the external device is a display apparatus, the display apparatus may display a message "Baby is crying." The control signal may include a command to directly control the external device 20. Otherwise, the control signal may include a result of detecting the acoustic event by the acoustic event detecting apparatus 100, and may include a signal for indirectly controlling operations of the external device 20 that is influenced by the result of detecting the acoustic event.

Figure 2:
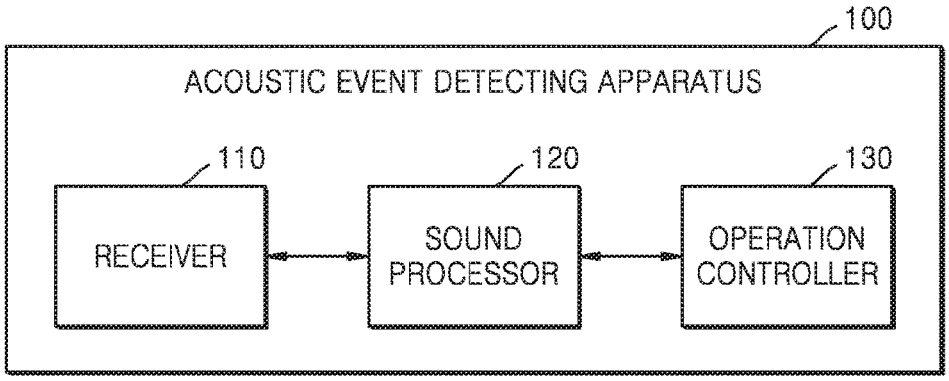
FIG. 2 is a block diagram of an acoustic event detecting apparatus according to an exemplary embodiment.

FIG. 2 is a block diagram of an acoustic event detecting apparatus 100 according to an exemplary embodiment.

As shown in FIG. 2, the acoustic event detecting apparatus 100 according to the present exemplary embodiment may include a receiver 110, a sound processor 120, and an operation controller 130.

The sound processor 120 and the operation controller 130 may be implemented as hardware such as FPGA or ASIC, software, or a combination of hardware and software. However, the sound process 120 and the operation controller 130 are not limited to software or hardware, but may be configured to exist in a storage medium that is addressable or may be configured to reproduce one or more processors.

Therefore, as an example, the sound processor 120 and the operation controller 130 may include components such as software components, object-oriented software components, class components, and task components, processes, functions, characteristics, procedures, sub-routines, segments of program code, drivers, firmware, micro codes, data, databases, data structures, tables, arrays, and variables. The components and functions provided in the sound processor 120 and the operation controller 130 may be combined into a less number of components or may be divided into additional components. For example, the acoustic event detecting apparatus 100 according to the present exemplary embodiment may be included in at least one of home electronic appliances, portable terminals, and safety products, or may be wired/wirelessly connected to at least one of the home electronic appliances, the portable terminals, and the safety products. The home electronic appliances may include, for example, a refrigerator, a television (TV), a vacuum cleaner, and a washing machine. The portable terminals may include, for example, a smartphone, a laptop computer, and a personal digital assistant (PDA). The safety products are devices for preventing risks caused by carelessness of a user using various household equipment, and may include, for example, a gas valve blocking device or a power disconnecting device.

The receiver 110 receives an acoustic input from the outside. The receiver 110 may directly convert external sound into electric acoustic data by including a microphone. Otherwise, the receiver 110 may receive acoustic data that is converted via a microphone included in a separate device from the acoustic event detecting apparatus 100 as an acoustic input via wires or wirelessly. Therefore, the receiver 110 may further include a communicator (not shown) that may communicate with an external device via wired or wireless communication.

The receiver 110 may convert external sound into electric acoustic data by using a microphone. The receiver 110 may receive an acoustic input from the outside. The receiver 110 may convert and output the received acoustic input into a format that the sound processor 120 may process. The receiver 110 may configure various noise reduction algorithms for removing noise from the acoustic input.

In FIG. 2, the receiver 110 is shown as being included in the acoustic event detecting apparatus 100; however, the receiver 110 of the present exemplary embodiment may be included in an additional device that may be connected to the acoustic event detecting apparatus 100 through wired/wirelessly communication. For example, the acoustic event detecting apparatus 100 included in one of the portable terminals and the home electronic appliances may use a microphone included in the other of the portable terminal and the home electronic appliances as the receiver 110.

The sound processor 120 extracts frequency characteristics of the acoustic input received through the receiver 110, and analyzes the frequency characteristics to determine whether a first acoustic event has occurred. The sound processor 120 may compare the frequency characteristics of the acoustic input with those of a plurality of acoustic models corresponding to a plurality of acoustic events stored in advance so as to determine which one of the plurality of acoustic events has occurred. The frequency characteristics may denote distribution of frequency components of the acoustic input, which are extracted by analyzing a frequency spectrum of the acoustic input.

The sound processor 120 may calculate a plurality of similarity values between the frequency characteristics of the acoustic input and the frequency characteristics of the plurality of acoustic models corresponding to the plurality of acoustic events. The sound processor 120 may select an acoustic event corresponding to the acoustic model with the highest similarity to the acoustic input from among the plurality of acoustic events, based on the plurality of similarity values. The sound processor 120 may determine that the first acoustic event has occurred, when the selected acoustic event is the first acoustic event.

Therefore, the sound processor 120 may include a storage (not shown) for storing the plurality of acoustic models corresponding to the plurality of acoustic events.

Also, when it is determined that there is a first acoustic event by analysing the acoustic input, the sound processor 120 may extract characteristics of the acoustic input. For example, the characteristic of the acoustic input may include at least one of the first acoustic input that is determined to occur based on the acoustic input, a direction of receiving the acoustic input, a magnitude of the acoustic input, and a frequency characteristic of the acoustic input.

The sound processor 120 may determine whether an effective sound is input or not based on the acoustic input received through the receiver 110. The sound processor 120 may measure an acoustic level of the acoustic input by performing an analog to digital (A/D) conversion of the acoustic input and analyzing the result of the conversion. The sound processor 120 may determine that an effective acoustic input is received in a case where the level of the acoustic input is equal to or greater than a critical level. The effective acoustic input may denote an acoustic input having an acoustic level that is high enough to detect an acoustic input from the acoustic input. For example, the sound processor 120 may detect acoustic events from all the acoustic inputs by using a critical level that is set at a very low level or at 0.

The sound processor 120 may remove echo from the acoustic input. The echo may denote an acoustic signal output from a speaker of the acoustic event detecting apparatus 100 and included in the acoustic input received through the receiver 110. In a case where the echo is included in the acoustic input received by the acoustic event detecting apparatus 100, the sound processor 120 removes the echo from the acoustic input received through the receiver 110.

The sound processor 120 may determine a type of the acoustic event by analyzing the acoustic input received through the receiver 110. The sound processor 120 may analyze sound relating to various acoustic events (for example, baby crying sound, dog barking sound, horn sound, fire alarm sound, screaming sound, subway sound, etc.) and compare the sound with the plurality of acoustic models to determine the type of acoustic event that has occurred.

The acoustic models may denote frequency property values including common features of the sounds relating to the plurality of acoustic events. The acoustic model may be extracted by analyzing frequency characteristics of the sound relating to the each of the acoustic events. For example, the acoustic model may be a Gaussian mixture model corresponding to the frequency distribution characteristic of the sound relating to each of the acoustic events.

The sound processor 120 may extract a characteristic value of the acoustic input and may compare the characteristic value with those of the acoustic models that are stored in advance through a predetermined calculation process. The characteristic value of the acoustic input may be a value representing frequency characteristics of the acoustic input. The sound processor 120 determines the acoustic model that is the closest to the acoustic input from among the plurality of acoustic models so as to determine the type of the acoustic input that has occurred.

The operation controller 130 executes an operation corresponding to the acoustic event. For example, the operation controller 130 notifies a user of a result of detecting the acoustic event, or may transmit a control signal to an external device for controlling an external device (e.g., a smartphone, a smart TV, a smart watch, etc.). In addition, the operation controller 130 generates an image representing the characteristic of the acoustic input, and provides the user with the generated image.

Figure 3:
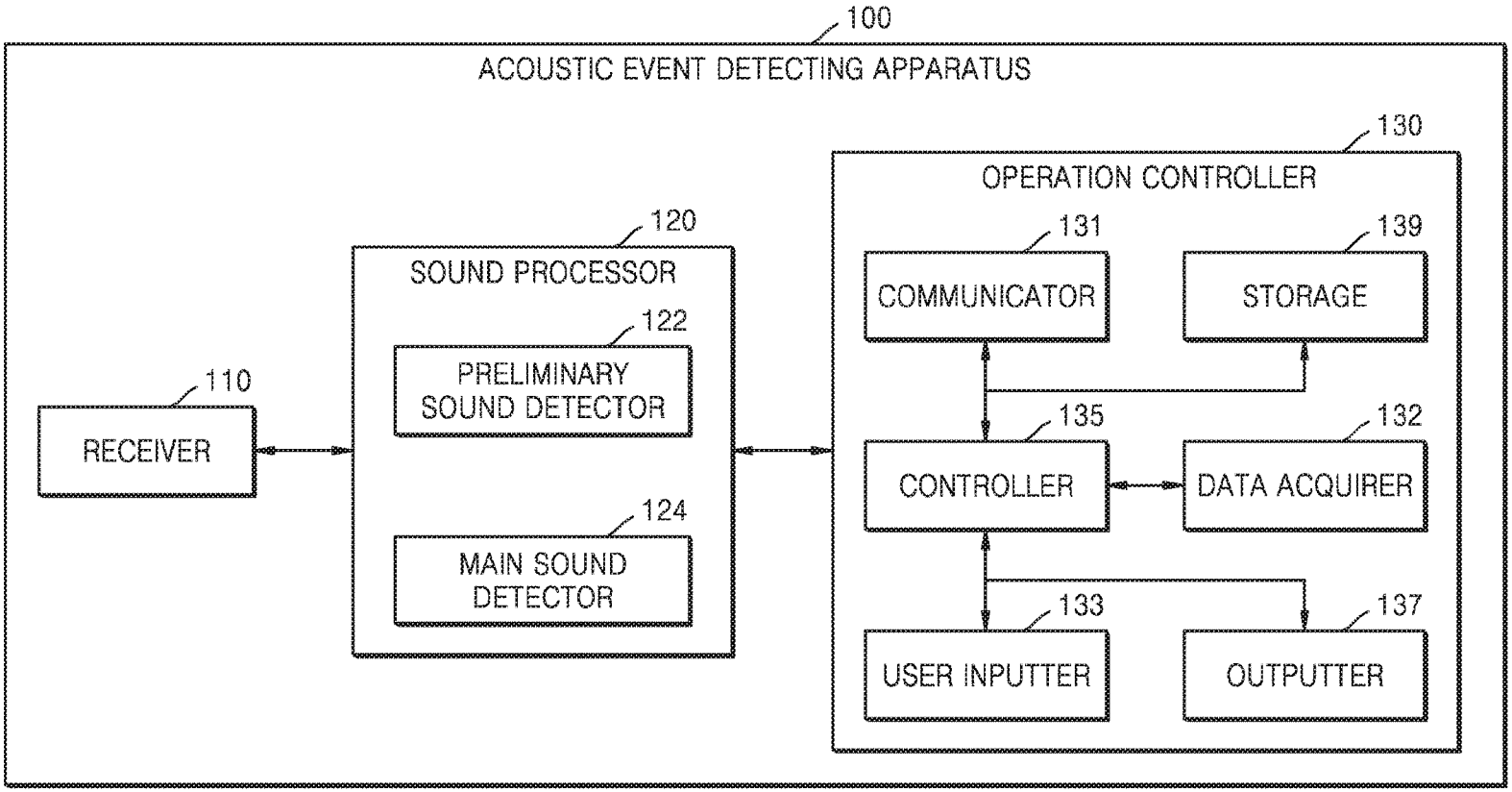
FIG. 3 is a block diagram of the acoustic event detecting apparatus in further detail, according to an exemplary embodiment.

FIG. 3 is a detailed block diagram of an acoustic event detecting apparatus according to an exemplary embodiment.

As illustrated in FIG. 3, the sound processor 120 according to the exemplary embodiment may include a preliminary sound detector 122 and a main sound detector 124. In addition, the operation controller 130 according to the exemplary embodiment may include a communicator 131, a data acquirer 132, a user inputter 133, a controller 135, an outputter 137, and a storage 139. The acoustic event detecting apparatus 100 according to the exemplary embodiment may receive an acoustic input from the outside via the receiver 110. For example, the acoustic event detecting apparatus 100 according to the exemplary embodiment may detect an acoustic event or may identify external environment by using the acoustic input received via a microphone of an electronic device such as a smart phone and a smart TV.

The receiver 110 according to the exemplary embodiment may directly sense the acoustic input from the outside by including a plurality of microphones, or may acquire acoustic data that is converted by a microphone included in a separate device from the acoustic input detecting apparatus 100 as an acoustic input through wired or wireless communication. For example, the receiver 110 may receive an acoustic input via a microphone that is placed on a space where an acoustic event is likely to occur. A space where an acoustic event is likely to occur may include, for example, a space adjacent to an interphone through which doorbell frequently rings, a room where baby crying sound is likely to be detected because a baby is sleeping, an emergency bell, a front door from which door opening/closing sound frequency occurs, etc.

The acoustic event detecting apparatus 100 according to the exemplary embodiment may improve an accuracy of detecting the acoustic event, by analysing multi-channel acoustic inputs received through a plurality of microphones. However, if the multi-channel acoustic inputs received through the plurality of microphones are analysed every time, power consumption of the acoustic event detecting apparatus 100 is excessive.

Therefore, in the sound processor 120 according to the exemplary embodiment, the preliminary sound detector 122 performs an acoustic event detecting operation with low accuracy, and then, when it is determined that a predetermined acoustic event has occurred, the main sound detector 124 may perform an acoustic event detecting operation with high accuracy.

The preliminary sound detector 122 first analyses an acoustic input received through a single microphone, and after that, may determine whether a predetermined acoustic event has occurred. The preliminary sound detector 122 may determine a largest acoustic input between the acoustic input received via the microphone included in the receiver 110 and an acoustic input that is transmitted from an external device to the receiver 110 through a wired or wireless communication. The preliminary sound detector 122 may detect an acoustic event from the acoustic input received through the microphone that receives the largest acoustic input.

When the preliminary sound detector 122 determines that the predetermined acoustic event has occurred, the main sound detector 124 analyses the acoustic input by using a plurality of microphones in order to detect the acoustic event more accurately.

The acoustic event detecting apparatus 100 according to the exemplary embodiment does not process the acoustic input by using the plurality of microphones every time, but detects a predetermined acoustic event by using a single microphone. Then, when it is determined that the predetermined acoustic event has occurred, the acoustic input received through the plurality of microphones is processed to reduce the power consumption of the acoustic event detecting apparatus 100.

Operations of the sound processor 120 including the preliminary sound detector 122 and the main sound detector 124 will be described in more detail later with reference to FIGS. 5 to 8.

The communicator 131 is connected through wired/wireless communication to a network to communicate with an external device or a server. The communicator 131 may transmit/receive data about at least one of the sound, the image, and the moving picture, or the control signal for controlling operations of the acoustic event detecting apparatus 100 or the external device.

The communicator 131 may be connected through wired/wireless communication to a home network to transmit/receive data to/from the home electronic appliances, and is connected to a base station or a server on a mobile communication network to transmit/receive a wireless signal to/from a portable terminal. The wireless signal may include a voice signal, a video call signal, or various types of data according to transmission of text/multimedia messages. For example, the communicator 131 according to the exemplary embodiment may provide the user with information via the external device by communicating with the external device, so that the user may recognize that the predetermined acoustic event has occurred by using at least one of time, an acoustic sense, and a tactile sense.

The data acquirer 132 may include a microphone and/or a camera (not shown) for acquiring data about at least one of sound, image, and video. In FIG. 3, the receiver 110 and the data acquirer 132 are separately provided, but are not limited thereto, that is, the data acquirer 132 may be integrated with the receiver 110. The camera included in the data acquirer 132 may process image frames of, for example, a still image, a video, etc. obtained by an image sensor.

The user inputter 133 may generate input data for the user to control the operations of the acoustic event detecting apparatus 100. The user inputter 133 may be configured as a keypad, a dome switch, a touch pad (for example, a capacitive overlay type, a resistive overlay type, an infrared beam type, a surface acoustic wave type, an integral strain gauge type, and a piezo electric type), a jog wheel, a jog switch, etc. In particular, if the touch pad configures a layered structure with the outputter 137 that will be described later, it may be referred as a touchscreen.

The outputter 137 may output an audio signal, an image signal, or an alarm signal. The outputter 137 may provide the user with various information processed in the acoustic event detecting apparatus 100 or an operating status of the acoustic event detecting apparatus 100.

For example, the outputter 137 according to the exemplary embodiment may provide the user with the information so that the user may recognize that the predetermined acoustic event has occurred by using at least one of time, acoustic sense, and the tactile sense.

The outputter 137 may output and display information processed by the acoustic event detecting apparatus 100. For example, the outputter 137 may display a user interface (UI) or a graphic user interface (GUI) about operations and function settings of the acoustic event detecting apparatus 100. In addition, as described above, if the outputter 137 and the touch pad configure a layered structure as a touchscreen, the outputter 137 may be used as an input unit, as well as the outputter. The outputter 137 may include at least one of a liquid crystal display (LCD), a thin film transistor (TFT)-LCD, an organic light-emitting diode, a flexible display, and a three-dimensional (3D) display.

For example, the outputter 137 may display an image representing the characteristic of the acoustic input. For example, the image representing the characteristic of the acoustic input may include an image representing at least one of an icon representing the first acoustic event that is determined to occur based on the acoustic input, an icon representing a direction of receiving the acoustic input, a magnitude of the acoustic input, and a frequency characteristic of the acoustic input.

Also, the outputter 137 may output the acoustic input received through the receiver 110 or stored in the storage 139. The outputter 137 may output the acoustic input related to the operations of the acoustic event detecting apparatus 100. The outputter 137 may include a speaker or a buzzer.

Also, the outputter 137 may provide the user with the information related to the acoustic event detecting apparatus 100 in a format other than the audio signal or the video signal. For example, the outputter 137 may output a signal as a vibration.

The controller 135 may control overall operations of the acoustic event detecting apparatus 100. That is, the controller 135 may control operations of the receiver 110, the sound processor 120, and the operation controller 130 shown in FIG. 1. Some or all of the sound detecting unit 122, the echo remover 124, the acoustic event detector 125, and the storage 139 of the acoustic event detecting apparatus 100 may be driven by a software module of the controller 135; however, the exemplary embodiments are not limited thereto, and some of the above components may be driven by hardware. Also, at least some of the sound detecting unit 122, the echo remover 124, the acoustic event detector 125, and the storage 139 of the acoustic event detecting apparatus 100 may be included in the controller 135; however, the exemplary embodiments are not limited thereto.

The storage 139 may store programs for processing and controlling of the controller 135, or may temporarily store input/output data (for example, messages, still images, moving pictures, etc.).

The storage 139 may include a storage medium of at least one of a flash memory type, a hard disk type, a multimedia card micro type, a card type memory (for example, an SD or XD memory), a random access memory (RAM), a static RAM (SRAM), a read only memory (ROM), an electrically erasable programmable ROM (EEPROM), a programmable ROM (PROM), a magnetic memory, a magnetic disk, and an optical disk. Also, the acoustic event detecting apparatus 100 may manage a web storage performing a storage function of the storage 139 on the Internet.

Figure 4:
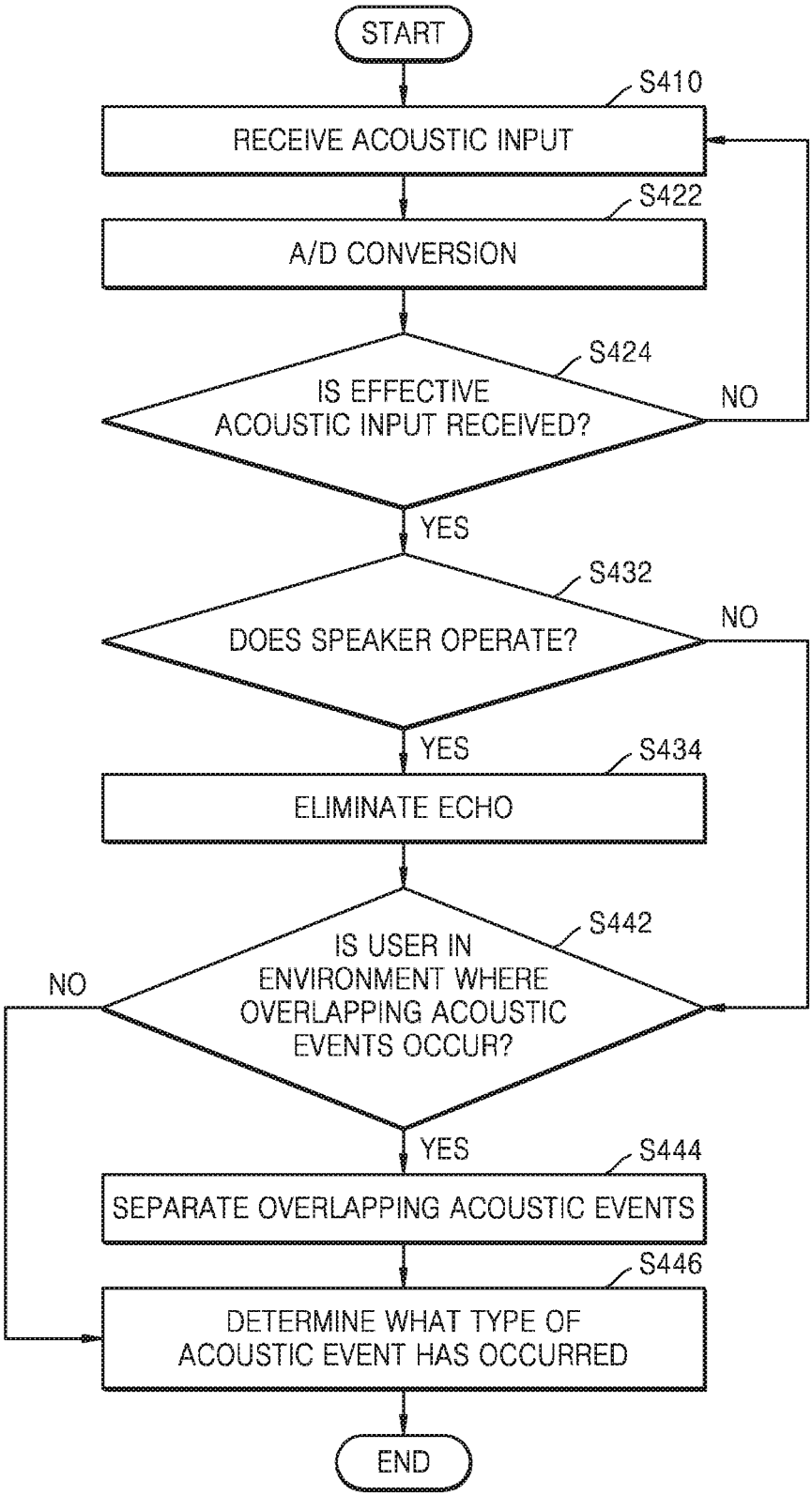
FIG. 4 is a flowchart illustrating a method of detecting an acoustic event according to an exemplary embodiment.

FIG. 4 is a flowchart illustrating a method of detecting an acoustic event according to an exemplary embodiment.

The method of detecting the acoustic event according to an exemplary embodiment may be performed by each of the components in the acoustic event detecting apparatus 100 shown in FIGS. 2 and 3. Therefore, the descriptions about the acoustic event detecting apparatus 100 shown in FIGS. 2 and 3 may be applied to the method of detecting the acoustic event illustrated in FIG. 4.

In operation 5410, the acoustic event detecting apparatus 100 of the present exemplary embodiment receives an acoustic input from outside.

In operation 5422, the acoustic event detecting apparatus 100 performs an A/D conversion of the acoustic input.

In operation 5424, the acoustic event detecting apparatus 100 may determine whether an effective acoustic input is received. In order to determine whether the effective acoustic input is received, the acoustic event detecting apparatus 100 may compare a level of the acoustic input that is converted into a digital signal with a critical level. The acoustic event detecting apparatus 100 determines that the effective acoustic input is received if the acoustic input has a level that is equal to the predetermined level or higher, and may perform subsequent operations for detecting the acoustic event.

The critical level is set to be high enough to determine which acoustic event has occurred outside of the acoustic event detecting apparatus 100, and may be set experimentally. Also, the sound detecting unit 122 may detect acoustic events from all of the acoustic inputs by using a predetermined level that is set to be very low or to 0.

In operation 5432, the acoustic event detecting apparatus 100 determines whether the speaker included in the outputter 137 operates. The acoustic event detecting apparatus 100 may determine whether the acoustic input may be output through the speaker of the acoustic event detecting apparatus 100.

If it is determined that the acoustic input is output through the speaker, the acoustic event detecting apparatus 100 removes echo in operation S434. The echo is an acoustic signal included in the acoustic input received in the operation S410 and output through the speaker of the acoustic event detecting apparatus 100. When the acoustic input includes the echo, the acoustic event detecting apparatus 100 may remove the echo to improve accuracy in detecting the acoustic event. Also, according to the acoustic event detecting apparatus 100 of the present exemplary embodiment, the echo removing operation is not performed in a case where there is no need to remove the echo, that is, when the acoustic input is not output through the speaker, and thus, unnecessary power consumption may be prevented.

In operation S442, the acoustic event detecting apparatus 100 determines whether the acoustic event detecting apparatus 100 is located in an environment where overlapping acoustic events occur. The acoustic event detecting apparatus 100 may operate in a plurality of modes according to the complexity of the environment where the acoustic event detecting apparatus 100 is located. For example, the acoustic event detecting apparatus 100 may operate in a multi-acoustic event detection (multi-AED) mode or a simple acoustic event detection (simple-AED) mode.

For example, if the acoustic event detecting apparatus 100 is located at an environment where a plurality of acoustic events occur simultaneously and overlap with each other, the acoustic event detecting apparatus 100 may operate in the multi-AED mode according to setting of the user. For example, if a child and a parent go out, it is expected that music is playing in restaurants or parks and various sounds such as voices of people of a baby crying sound may overlap. In such an environment, if the user wants to detect only a certain acoustic event, for example, a baby crying, the user may set the acoustic event detecting apparatus 100 to operate in the multi-AED mode.

Also, if the acoustic event detecting apparatus 100 is not located in an environment where the plurality of acoustic events occur simultaneously, the acoustic event detecting apparatus 100 may operate in the simple-AED mode according to selection of the user. For example, if the user wants to detect only a certain acoustic event, for example, a baby crying, when they sleep at night, the user may set the acoustic event detecting apparatus 100 to operate in the simple-AED mode.

The acoustic event detecting apparatus 100 according to the present exemplary embodiment may be configured to operate in different modes according to whether the acoustic event detecting apparatus 100 is located in the environment where the plurality of acoustic events occur simultaneously. Therefore, when the acoustic event detecting apparatus 100 operate in the simple-AED mode, an operation for isolating the overlapping acoustic events is not necessary, and unnecessary calculation operations and power consumption may be reduced.

If it is determined that the acoustic event detecting apparatus 100 is located in the environment where the overlapping acoustic events frequently occur, the acoustic event detecting apparatus 100 isolates the overlapping acoustic events in operation S444. For example, the acoustic event detecting apparatus 100 may isolate the acoustic events by dividing acoustic signals through a frequency characteristic analysis. Whether the acoustic event detecting apparatus 100 is located in the environment where the overlapping acoustic events occur frequently may be determined by an input of the user.

In operation S446, the acoustic event detecting apparatus 100 may analyze the acoustic input to determine a type of the acoustic event that has occurred. The acoustic event detecting apparatus 100 learns sounds related to various acoustic events, for example, a baby crying sound, a dog barking sound, a horn sound, a fire alarm sound, a screaming sound, a subway sound, etc., in advance so as to determine acoustic models respectively representing the acoustic events. The acoustic event detecting apparatus 100 compares the acoustic input with at least one acoustic model to determine the type of the acoustic event that has occurred.

The acoustic event detecting apparatus 100 may analyze frequency characteristics of the acoustic input to extract a feature value of the acoustic input. The acoustic event detecting apparatus 100 may select the acoustic model that is most similar to the extracted feature value by comparing the feature value with the plurality of acoustic models that are stored in advance. In order to statistically select the acoustic model that is the most similar to the extracted feature value, the acoustic event detecting apparatus 100 may calculate a plurality of similarity values representing similarities between the plurality of acoustic models and the extracted feature value. The plurality of similarity values may be obtained through various calculating processes. Statistically selecting of the acoustic model that is the most similar to the extracted feature value denotes that the acoustic model corresponding to the highest similarity value from among the plurality of similarity values is selected as the acoustic event that has the highest probability of having occurred.

Figure 5:
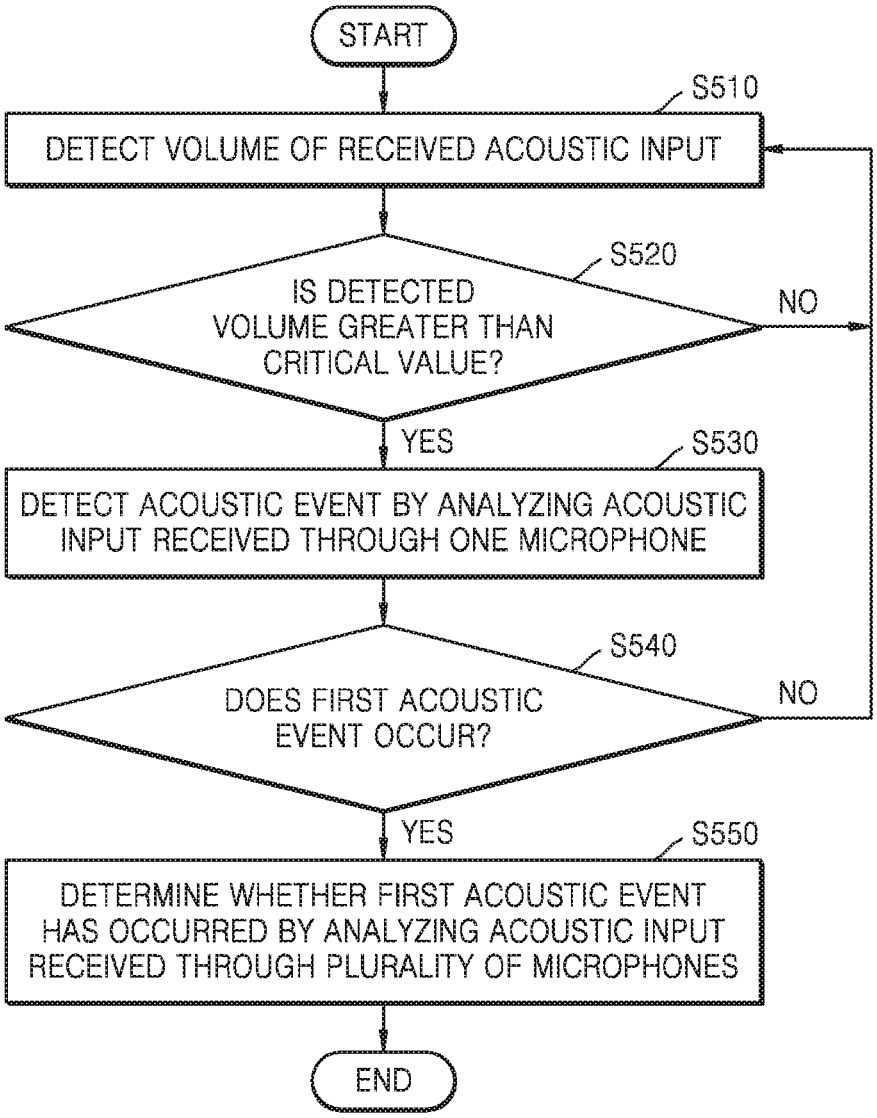
FIG. 5 is a flowchart illustrating a method of operating an acoustic event detecting apparatus, according to an exemplary embodiment.

FIG. 5 is a flowchart illustrating a method of operating an acoustic event detecting apparatus, according to an exemplary embodiment.

The acoustic event detecting method according to the exemplary embodiment may be embodied by each of the components of the acoustic event detecting apparatus 100 illustrated in FIGS. 2 and 3. Therefore, although omitted in following descriptions, the descriptions about the acoustic event detecting apparatus 100 illustrated in FIGS. 2 and 3 provided above may be applied to the acoustic event detecting method illustrated with reference to FIG. 5.

As shown in FIG. 5, the acoustic event detecting apparatus 100 according to the exemplary embodiment may detect a volume of an acoustic input received through a plurality of microphones in operation S510.

In operation S520, the acoustic event detecting apparatus 100 according to the exemplary embodiment may determine whether volume of an acoustic input received through each of the plurality of microphones exceeds a critical value. When it is determined that the volume of the acoustic input received through at least one of the plurality of microphones exceeds the critical value, the acoustic event detecting apparatus 100 may detect an acoustic event by analysing the acoustic input received through one microphone that receives the acoustic input exceeding the critical value (S530).

For example, when there are two or more microphones receiving the acoustic inputs exceeding the critical value, the acoustic event detecting apparatus may detect the acoustic event by analysing the acoustic input received through the microphone that receives the acoustic input showing a largest volume.

When it is determined that the volume of the acoustic input does not exceed the critical value in operation S520, the acoustic event detecting apparatus 100 does not perform an additional acoustic processing operation for detecting an acoustic event, but returns to operation S510 to continuously perform the operation of monitoring the acoustic input received through each of the plurality of microphones.

In operation S540, the acoustic event detecting apparatus 100 according to the exemplary embodiment may determine whether a first acoustic event has occurred.

When it is determined that the first acoustic event has occurred in operation S540, the acoustic event detecting apparatus 100 analyses multi-channel acoustic inputs received through the plurality of microphones and may determine whether the first acoustic event has occurred more accurately (S550).

However, when it is determined that the first acoustic event does not occur in operation S540, the acoustic event detecting apparatus 100 does not perform an operation of analysing the multi-channel acoustic inputs received through the plurality of microphones for detecting an acoustic event, but returns to operation S510 to continuously perform an operation of monitoring the acoustic input received through each of the plurality of microphones.

Figure 6:
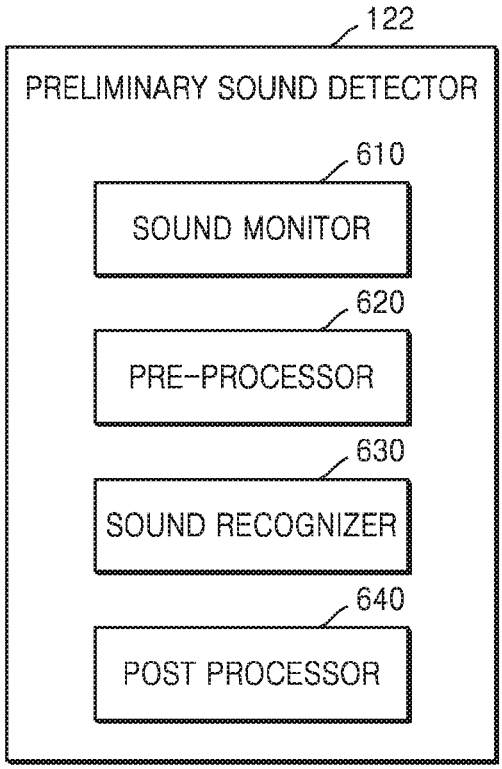
FIG. 6 is a block diagram of a preliminary sound detector according to an exemplary embodiment.

FIG. 6 is a block diagram of the preliminary sound detector according to an exemplary embodiment.

As shown in FIG. 6, the preliminary sound detector 122 according to the exemplary embodiment may include a sound monitor 610, a pre-processor 620, a sound recognizer 630, and a post-processor 640.

The sound monitor 610 may determine whether valid sound is received through the plurality of microphones. The sound monitor 610 may determine whether volume of the acoustic input from each of the plurality of microphones exceeds a critical value.

When it is determined that the acoustic input received through even one microphone exceeds the critical value, the sound monitor 610 may output the acoustic input received through the one microphone to the pre-processor 620. For example, the sound monitor 610 may output to the pre-processor 620 the acoustic input received through the microphone that receives the acoustic input with the largest volume from among the plurality of microphones receiving the acoustic inputs with the volumes exceeding the critical value.

When the acoustic inputs received through the plurality of microphones have volumes that are equal to or less than the critical value, the sound monitor 610 does not perform an additional acoustic processing operation for detecting the acoustic event, but may continuously perform the monitoring operation for determining whether the value acoustic input is received through each of the plurality of microphones.

The pre-processor 620 may analyse the acoustic input receives through one microphone and may detect an acoustic event. The pre-processor 620 may perform a processing operation for restraining noise components and for enhancing the acoustic signal within the acoustic input received through one microphone.

For example, the pre-processor 620 may remove noise or echo, and may extract frequency characteristics of the acoustic input that is necessary for detecting the acoustic event. The pre-processor 620 may use various noise removal algorithms, e.g., an enhanced variable rate codec (EVRC), for removing the noise. Detailed method for the pre-processor 620 of extracting the frequency characteristic of the acoustic input according to the exemplary embodiment will be described in more detail later with reference to FIG. 7.

The sound recognizer 630 of FIG. 6 may determine whether the predetermined acoustic event has occurred by comparing the frequency characteristic of the acoustic input extracted by the pre-processor 620 with frequency characteristics of acoustic models. For example, acoustic models may include Gaussian mixture model regarding frequency distribution characteristic of sounds related to each acoustic event.

The sound recognizer 630 according to the exemplary embodiment may use acoustic models generated from negative samples including sounds that are irrelevant with a predetermined acoustic event, as well as acoustic models generated from positive samples including sounds related to the predetermined acoustic event. Also, the sound recognizer 630 according to the exemplary embodiment may further use acoustic models about sounds that are similar to the predetermined acoustic event.

For example, the sound recognizer 630 may improve an accuracy of detecting an acoustic event, for example, a "baby crying" acoustic event, by using acoustic models generated from negative samples including sounds that may occur from an environment where a baby exists (e.g., voice of mother, sound from toys of the baby, etc.), as well as acoustic models regarding the baby crying sound.

The sound recognizer 630 generates acoustic models regarding "human speech" similar to the "baby crying" acoustic event, and may generate acoustic models about radio sound or music sound that may generate indoors, children sound from a playground outside the house, sounds generating from streets, cafes, offices, etc. The sound recognizer 630 may determine whether the "baby crying" acoustic event by comparing the generated acoustic models with the acoustic input.

Although the sound recognizer 630 uses the Gaussian mixture model in order to detect the acoustic event, but the inventive concept is not limited thereto. For example, the sound recognizer 630 according to the exemplary embodiment may detect the acoustic event by using machine learning algorithms such as support vector machine (SVM), neural network (NN), etc., as well as the Gaussian mixture model, and may use a simplified method that detects the acoustic event based on an intensity of the acoustic input, or existence of a certain frequency component.

The post-processor 640 may determine that the acoustic event has occurred, when the number of chunks that are classified as sounds related to a predetermined acoustic event within one window. That is, unless the predetermined acoustic event that is to be detected does generate sound for a very short period of time, the accuracy of detecting the acoustic event may be improved by taking into account the number of chunks related to the predetermined acoustic event included in one window.

Figure 7:
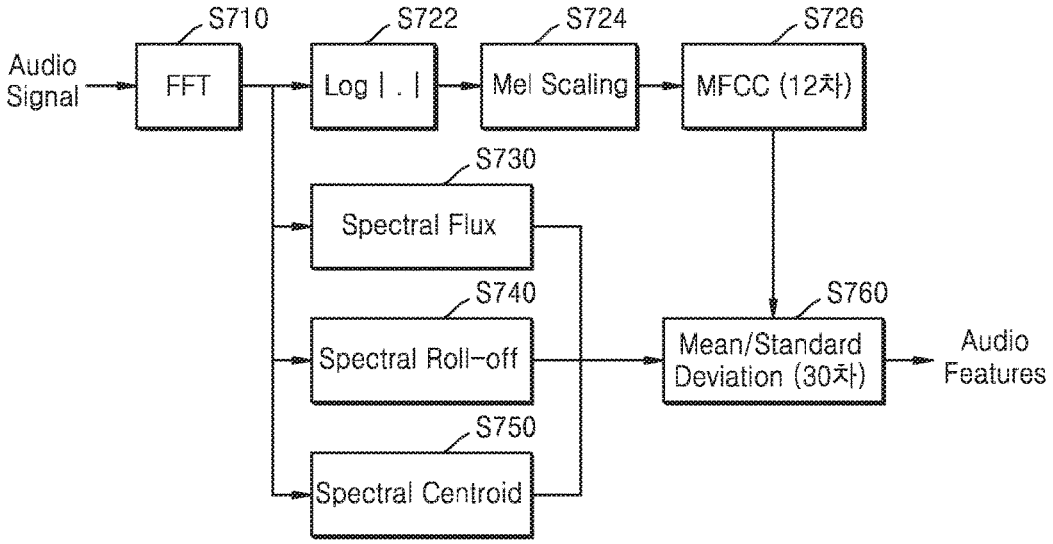
FIG. 7 is a flowchart illustrating a method of operating a pre-processor, according to an exemplary embodiment.

In addition, the pre-processor 620 according to the exemplary embodiment may execute the method of extracting the frequency characteristic of the acoustic input illustrated with reference to FIG. 7. However, the inventive concept is not limited to the example of FIG. 7, that is, the pre-processor 620 may extract various frequency characteristics by using various methods.

The pre-processor 620 may extract 12 mel-frequency cepstral (MFC) coefficients, spectral flux, spectral roll-off, and spectral centroid as frequency characteristics of the acoustic input. An average and a standard deviation of these 15 parameters are calculated for one second, and finally, 30 characteristic vector is made.

In operation S710, the pre-processor 620 converts an input audio signal into a frequency domain signal to generate a frequency spectrum. In FIG. 7, the frequency transformation of the audio signal is performed by using fast-Fourier transformation (FFT), but the inventive concept is not limited thereto, that is, a modified discrete transform (MDCT), wavelet packet transform (WPT), frequency varying modulated lapped transform (FV-MLT), and similar methods may be used.

The pre-processor 620 takes logs of a power of the frequency spectrum (S722), and maps the log values of the powers of the frequency spectrum to a mel scale (S724). The pre-processor 620 performs a discrete cosine transformation of mel log powers obtained in operation S724, and may acquire amplitudes of the spectrum obtained according to the discrete cosine transformation result as MFC coefficients.

In addition, in operation S730, the pre-processor 620 may obtain spectral flux. The spectral flux is a value representing a degree that an energy of the frequency spectrum shows over subsequent several frequency bands. The spectral flux may be expressed by Equation 1 below.

$$F_i = \sum_{i=N_o}^{N} (|S_i(j)| - |S_{i-1}(j)|)^2 \quad \text{[Equation 1]}$$

In Equation 1 above, $S_i(j)$ denotes an amplitude corresponding a frequency band j in a frequency spectrum.

In operation S740, the pre-processor 620 may acquire spectral roll-off. The spectral roll-off is a value representing asymmetry of an energy, that is, how the energy is concentrated on a certain frequency band. The spectral roll-off may be expressed by Equation 2 below.

$$\max\left\{ f(R_i): \sum_{i=N_o}^{R_i} |S_i(j)|^2 = 0.85 \times \sum_{i=N_o}^{N} |S_i(j)| \right\}^2 \quad \text{[Equation 2]}$$

In Equation 2 above, $S_i(j)$ denotes an amplitude corresponding to a frequency band j within the frequency spectrum.

In operation S750, the pre-processor 620 may acquire spectral centroid. The spectral centroid is a frequency corresponding to a centroid of energy in the frequency spectrum. The spectral centroid may be expressed by Equation 3 below.

$$C_i = \frac{\sum_{i=N_o}^{N} (|S_i(j)|^2 \times j)}{\sum_{i=N_o}^{N} (|S_i(j)|^2)} \quad \text{[Equation 3]}$$

In Equation 3 above, $S_i(j)$ denotes an amplitude corresponding to a frequency band j within the frequency spectrum.

In operation S760, the pre-processor 620 may generate 30 characteristic vectors by calculating an average and a standard deviation for one second of 15 parameters including 12 MFC coefficients, the spectral flux, the spectral roll-off, and the spectral centroid. The pre-processor 620 may output the generated 30 characteristic vectors as values representing the frequency characteristic of the acoustic input.

Figure 8:
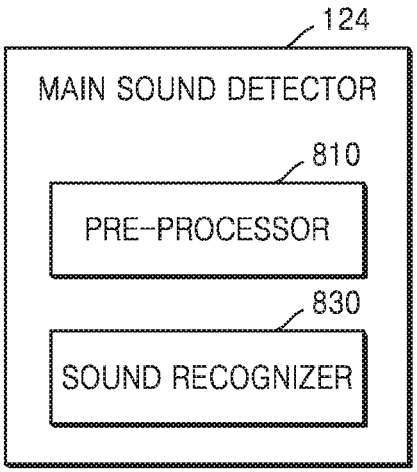
FIG. 8 is a block diagram of a main sound detector according to an exemplary embodiment.

FIG. 8 is a block diagram of the main sound detector 124 according to the exemplary embodiment.

When the preliminary sound detector 122 determines that the predetermined acoustic event has occurred, the main sound detector 124 analyses the acoustic inputs received through the plurality of microphones so as to determine whether the predetermined acoustic event has occurred more accurately.

As illustrated in FIG. 8, the main sound detector 124 may include a pre-processor 820 and a sound recognizer 830. The descriptions about the pre-processor 620 and the sound recognizer 630 of FIG. 7 may be applied to the pre-processor 820 and the sound recognizer 830 of FIG. 8, and thus, detailed descriptions are omitted here.

The pre-processor 820 of the main sound detector 124 restrains the noise components included in the acoustic inputs received through the plurality of microphones as small as possible so as to detect the acoustic event accurately. Therefore, the pre-processor 820 may use a multi-channel noise suppression method, a beamforming method, a blind source separation method, a multi-channel acoustic echo cancellation method, etc. in order to remove noise.

In addition, the pre-processor 820 of the main sound detector 124 processes the acoustic inputs received through the plurality of microphones, and thus, may extract a target sound more clearly by using a spatial difference between the target sound related to the predetermined acoustic event and noise.

The sound recognizer 830 may operate in three modes.

A first sound recognition mode is a recognition mode for detecting the acoustic event by using acoustic models that have been learned in advance.

A second sound recognition mode is an adaptation mode for adaptively updating the acoustic models that have been learned in advance, based on the received acoustic input.

When the acoustic models that have been learned in advance are used, a performance of detecting the acoustic event may degrade in a case where the sound samples used to generate the acoustic models are different from sound related to an actual acoustic event. Therefore, the performance of detecting the acoustic event may be improved by adaptively updating the acoustic models based on the acoustic inputs.

A third sound recognition mode is an addition mode for newly generating an acoustic model based on a user input.

Sounds relating to an acoustic event may vary too much to extract common features from the sounds. For example, doorbell sound or telephone ring sound may vary in each house, and thus, it is difficult to generate one common acoustic model about the various doorbell ring sounds or the telephone ring sounds. Therefore, in this case, the acoustic event detecting apparatus 100 according to the exemplary embodiment may receive a target sound related to a predetermined acoustic event from a user, and generate an acoustic model by analyzing the target sound to improve the accuracy of detecting the acoustic event.

Hereinafter, a method of operating the acoustic event detecting apparatus will be described with reference to FIGS. 9 through 24 below. For convenience of description, a case where the acoustic event detecting apparatus determines whether a predetermined acoustic event has occurred will be described as an example; however, the exemplary embodiments are not limited thereto. That is, the acoustic event detecting apparatus according to the present exemplary embodiment may determine that a plurality of acoustic events from an acoustic input have occurred and may perform operations corresponding to the plurality of acoustic events.

As one of ordinary skill would appreciate, the method of operating the acoustic event detecting apparatus according to the present exemplary embodiment shown in FIGS. 9 through 24 may be applied to a case where the acoustic event detecting apparatus determines that the plurality of acoustic events have occurred.

Also, the method of operating the acoustic event detecting apparatus illustrated with reference to FIGS. 9 to 24 may be executed by the acoustic event detecting apparatus 100 illustrated with reference to FIGS. 2 to 8 according to the exemplary embodiment. Therefore, the detailed method of detecting the acoustic event illustrated above with reference to FIGS. 2 to 8 may be applied to the method of operating the acoustic event detecting apparatus illustrated with reference to FIGS. 9 to 24, and thus, overlapping descriptions will be omitted.

The acoustic event detecting apparatus 100 according to the present exemplary embodiment may detect a predetermined acoustic event (for example, an acoustic event related to a case where a baby is crying, a stranger trespasses in an empty house, etc.), and operate according to a detection result, and thus, may be used in a home monitoring system.

Figure 9:
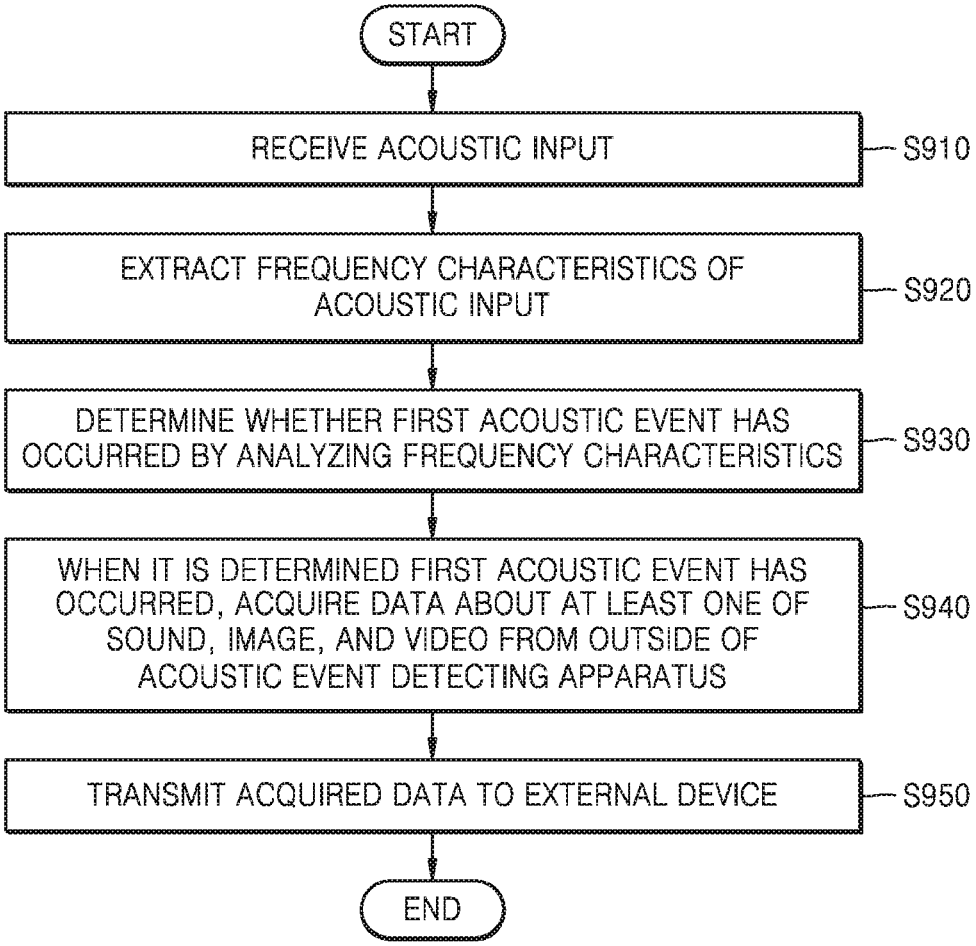
FIG. 9 is a flowchart illustrating a method of operating an acoustic event detecting apparatus, according to an exemplary embodiment.
Figure 10:
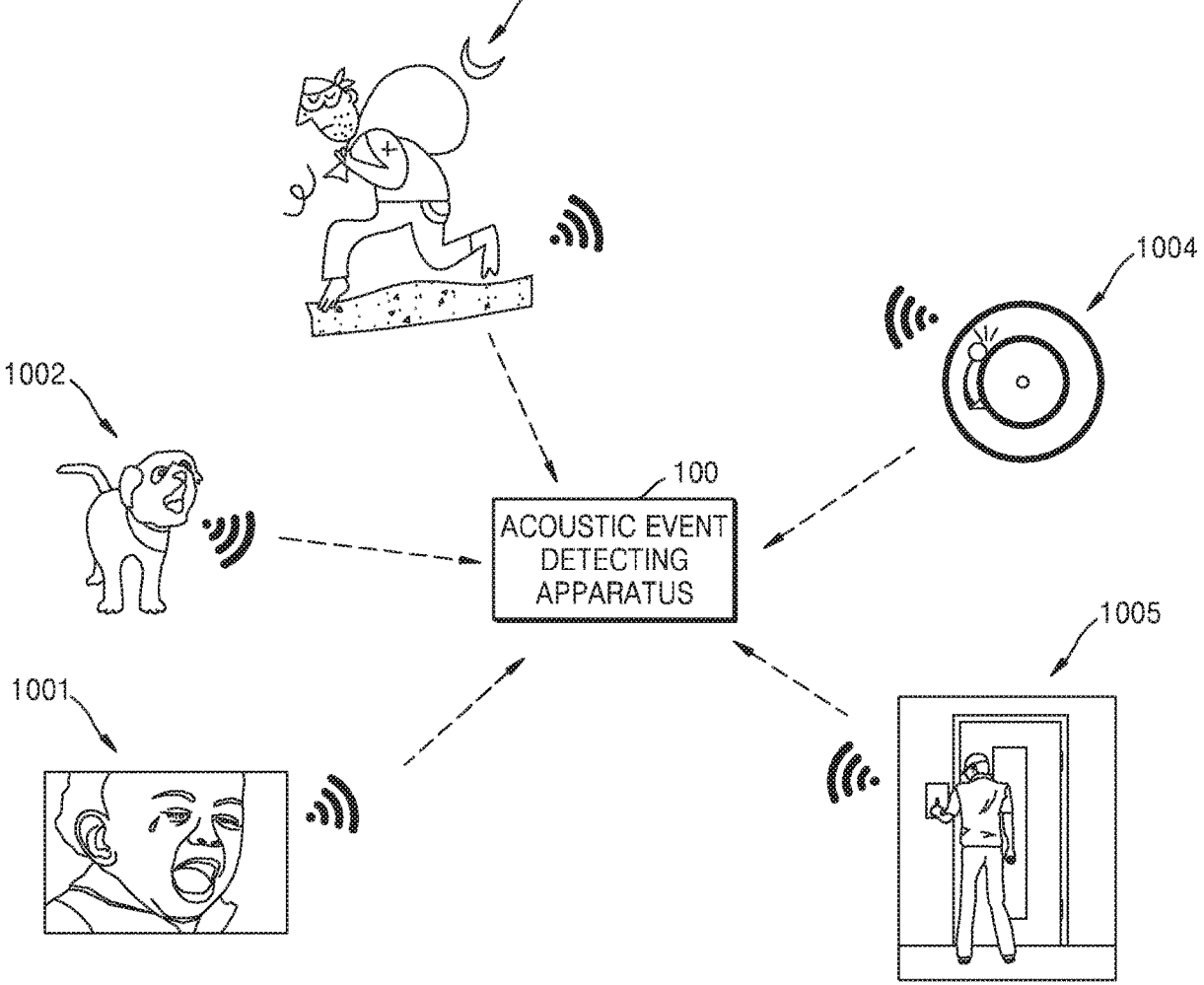
FIG. 10 is a diagram illustrating an acoustic event detected by an acoustic event detecting apparatus according to an exemplary embodiment.

FIG. 9 is a flowchart illustrating a method of operating an acoustic event detecting apparatus according to an exemplary embodiment.

In operation S910, the acoustic event detecting apparatus 100 according to the present exemplary embodiment may receive an acoustic input from outside of the acoustic event detecting apparatus 100.

In operation S920, the acoustic event detecting apparatus 100 may extract frequency characteristics of the acoustic input.

In operation S930, the acoustic event detecting apparatus 100 may analyze the frequency characteristics that are extracted to determine whether a first acoustic event has occurred.

The acoustic event detecting apparatus 100 of the present exemplary embodiment may determine that the first acoustic event has occurred, when an acoustic event related to at least one of a baby crying sound 1001, a pet barking sound 1002, a housebreaking sound 1003, an emergency alarm sound 1004, and a doorbell ringing sound 1005, as shown in FIG. 6, occurs.

When it is determined that the first acoustic event has occurred in operation S930, the acoustic event detecting apparatus 100 may acquire data about at least one of sound, an image, and a moving picture from an environment outside of the acoustic event detecting apparatus 100. The acoustic event detecting apparatus 100 may acquire data about at least one of the sound, the image, and the moving picture from the outside by using a microphone or a camera included in the acoustic event detecting apparatus 100.

In operation S940, the acoustic event detecting apparatus 100 may transfer the data to a first device (i.e., an external device).

For example, the acoustic event detecting apparatus 100 located inside a house transfers the data to the first device, and thus, a user of the first device may monitor the inside of the house even when he/she is outside of the house. Otherwise, the acoustic event detecting apparatus 100 transfers the data to a server and monitoring data of the acoustic event detecting apparatus 100 in the house may be stored in the server. When an acoustic event is detected, it may be set by the user in advance to which external device that the data will be transferred to. Also, it may be determined which external device that the data will be transferred to according to the type of the acoustic event.

In addition, when it is determined that the acoustic event has occurred, the acoustic event detecting apparatus 100 may receive at least one of the sound, the image, and the moving picture, and output it. That is, the acoustic event detecting apparatus 100 may support a voice call or a video call to the first device, when it is determined that the acoustic event has occurred.

In addition, the acoustic event detecting apparatus 100 may transmit a control signal for controlling operations of a second device to the second device when it is determined that the acoustic event has occurred. The first device and the second device may respectively include at least one of the home electronic appliances, the portable terminals, and the safety products.

Figure 11:
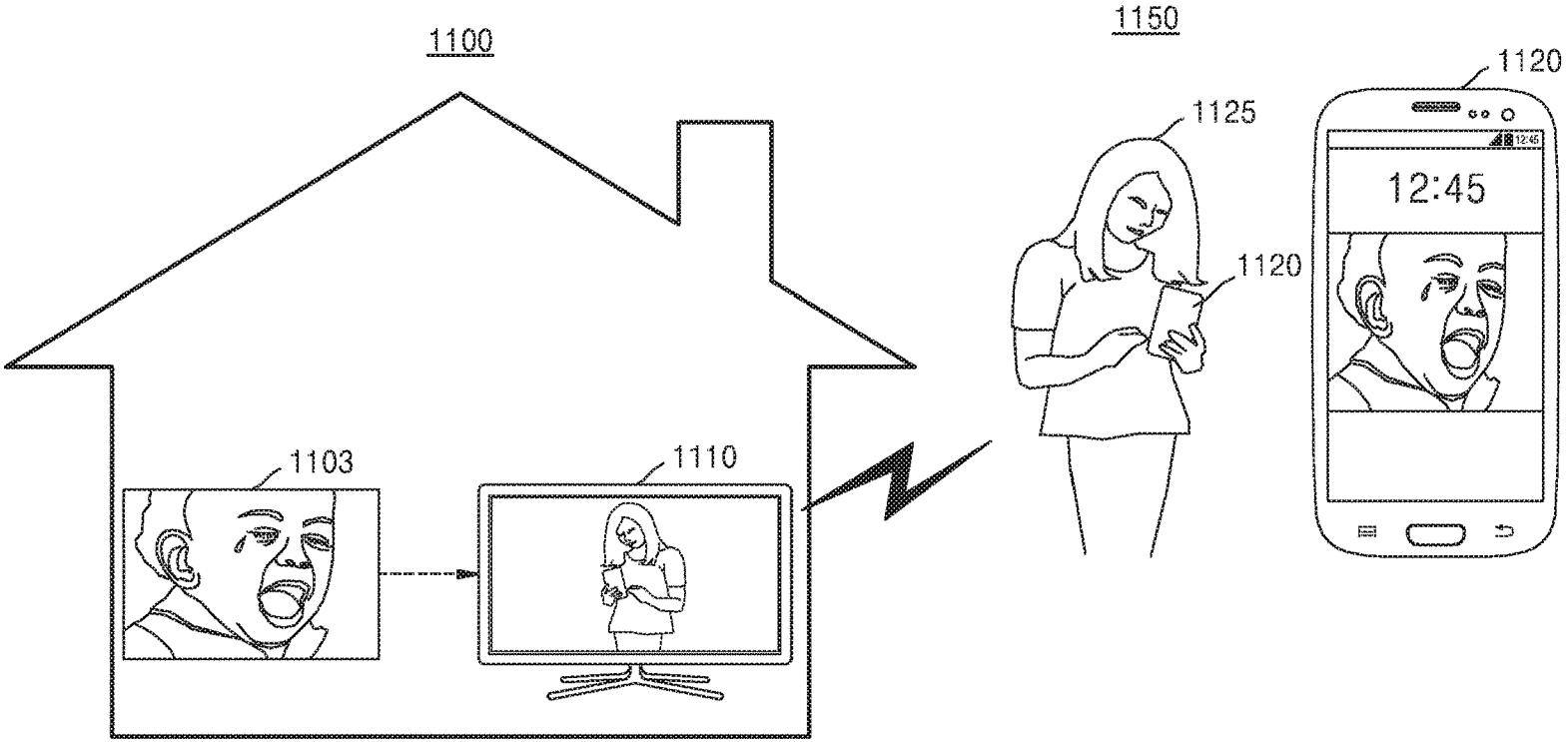
FIG. 11 is a diagram illustrating a method of operating an acoustic event detecting apparatus, according to an exemplary embodiment.

FIG. 11 is a diagram illustrating a method of operating the acoustic event detecting apparatus according to an exemplary embodiment.

FIG. 11 shows a case where a guardian 1125 is located in external space 1150 which is outside of a house 1100 in which a baby 1103 exists, for example, a case where the guardian 1125 leave the house 1100 to travel to an adjacent location such as a supermarket or a mail box.

An acoustic event detecting apparatus 1110 according to the present exemplary embodiment may receive an acoustic input generated in the house 1100. As shown in FIG. 11, the acoustic event detecting apparatus 1110 may be included in a home electronic appliance such as a TV or connected to the home electronic appliance though wired/wireless communication to receive an acoustic input by using a microphone included in the home electronic appliance. The acoustic event detecting apparatus 1110 analyzes frequency characteristics of the acoustic input generated in the house 1100 to determine whether an acoustic event relating to the baby 1103 crying has occurred. When it is determined that the baby 1103 is crying, the acoustic event detecting apparatus 1110 may notify the guardian 1125 of a determination result.

The acoustic event detecting apparatus 1110 may transmit at least one of a text communicating that the baby 1103 is crying, the crying sound of the baby 1103, an image of the baby 1103 crying, and a moving picture of the baby 1103 to a portable terminal 1120 that the guardian 1125 carries. Therefore, the guardian 1125 may be provided with the text information, the sound, the image, and/or the moving picture of the baby 1103 from the acoustic event detecting apparatus 1110, and thus, the guardian 1125 may monitor the baby 703 even when the guardian is outside of the house 1100.

Also, the acoustic event detecting apparatus 1110 may receive and output text information, a sound, an image, and a moving picture about the guardian 1125 from the portable terminal 1120 so as to comfort the baby 1103 who is crying.

Otherwise, when it is determined that the baby 1103 is crying, the acoustic event detecting apparatus 1110 may transmit a control signal for controlling operations of the home electronic appliance to the home electronic appliance. For example, the acoustic event detecting apparatus 1110 may transmit a control signal to the TV so that the TV may select a baby channel and display the baby channel so as to comfort the baby 1103 who is crying.

Therefore, according to the acoustic event detecting apparatus 1110 of the present exemplary embodiment, while the baby 1103 is comforted through a video call with the guardian 1125 or watching the kids channel, the guardian 1125 may travel back to the house 1100 while monitoring the baby 1103.

Otherwise, if the baby 1103 does not stop crying or the guardian 1125 is not able to immediately travel back to the house 1100, the acoustic event detecting apparatus 1110 may notify a predetermined user (for example, a relative or a neighbor that lives near to the house 1100) of an emergency status. Otherwise, if the guardian 1125 is not able to monitor the baby 1103, the guardian 1125 may control the acoustic event detecting apparatus 1110 by using the portable terminal 1120. That is, the guardian 1125 may control the acoustic event detecting apparatus 1110 so as to provide a predetermined user with the text information, the sound, the image, and the moving picture about the baby 1103.

FIG. 11 shows a case where the acoustic event detecting apparatus 1110 included in the home electronic appliance such as a TV transmits a result of detecting the acoustic event to the portable terminal 1120 as an example; however, the exemplary embodiments are not limited thereto. The acoustic event detecting apparatus 100 may be included in a portable terminal so as to transmit a result of detecting an acoustic event to a home electronic appliance.

For example, if a guardian does household chores in a kitchen or a living room when a baby sleeps in another room, the acoustic event detecting apparatus 100 according to an exemplary embodiment may be used. The guardian may place a portable terminal including the acoustic event detecting apparatus 100 according to the present exemplary embodiment next to the baby while the baby is sleeping, and then, the guardian may do household chores in another space. When the baby starts crying, the acoustic event detecting apparatus 100 may notify the guardian of the baby's crying through a lamp or an electronic appliance of the space where the guardian exists. The acoustic event detecting apparatus 100 may transmit a control signal to the lamp or the electronic appliance to control the operations of the lamp or the electronic appliance, so as to notify the guardian of the result of detecting the acoustic event.

FIG. 11 shows a case where the crying sound of the baby 1103 is detected as an example; however, the exemplary embodiments are not limited thereto.

As an example, when the user goes out of the house or sleeps in a room, the acoustic event detecting apparatus 100 according to an exemplary embodiment may be used to monitor for trespass of a stranger.

When the acoustic event detecting apparatus 100 receives a sound, for example, a sudden breaking sound, a door opening sound, a voice of a person, or a footstep sound, the acoustic event detecting apparatus 100 may analyze frequency characteristics of the acoustic input to determine whether an acoustic input related to a trespass of a stranger has occurred. When it is determined that there is a trespass of a stranger, the acoustic event detecting apparatus 100 may communicate the result to a designated destination such as the user, a security office, or a police station.

For example, the acoustic event detecting apparatus 100 may send a text message to a mobile terminal of a designated number or call a designated number to communicate the trespass of the stranger. Otherwise, the acoustic event detecting apparatus 100 may transmit at least one of a sound, an image, and a moving picture for monitoring inside the house to the mobile terminal of the designated number. Also, the acoustic event detecting apparatus 100 may automatically operate a home electronic appliance connected thereto to warn the stranger that they have been detected. For example, it is determined that there is trespass of the stranger, the acoustic event detecting apparatus 100 may make an emergency bell ring so that the stranger may be scared away.

As another example, in a case where a guardian goes out and there is only weaken elderly or weak person in the house, the acoustic event detecting apparatus 100 according to the present exemplary embodiment may be used.

The acoustic event detecting apparatus 100 may determine that a stranger visits the house if a doorbell sound or a knocking sound on a front door is input. When the acoustic event detecting apparatus 100 receives the doorbell sound or the knocking sound on the front door, the acoustic event detecting apparatus 100 may connect an intercom installed in the front door to a portable terminal of the guardian. That is, the acoustic event detecting apparatus 100 may support a voice call or a video call between the intercom provided in the front door and the portable terminal of the guardian. Otherwise, the acoustic event detecting apparatus 100 may transmit at least one of a sound, an image, and a moving picture about a status at the front door to the portable terminal of the guardian so that the guardian may monitor the status at the front door.

Therefore, according to the acoustic event detecting apparatus 100 of the present exemplary embodiment, even if there is no guardian in the house, the guardian may monitor the visiting of a stranger and may respond to the stranger as if he/she is in the house, and thus, the elderly or weak persons in the house may be protected.

As another example, the acoustic event detecting apparatus 100 may be used in a case where an emergency bell rings for notifying of a fire breaking out or other emergency states when the user goes out of the house.

If the acoustic event detecting apparatus 100 receives a sound of an emergency alarm for notifying a fire or a gas leakage, the acoustic event detecting apparatus 100 may determine that an acoustic event related to a negligence accident has occurred. When it is determined that the negligence accident has occurred, the acoustic event detecting apparatus 100 may communicate the accident to a number designated in advance such as the user, the security office, or the police station.

For example, the acoustic event detecting apparatus 100 may transmit a text message to a mobile terminal of the designated number or may call the designated number. Otherwise, the acoustic event detecting apparatus 100 may transmit at least one of a sound, an image, and a moving picture for monitoring the inside of the house to the mobile terminal of the designated number.

Also, the acoustic event detecting apparatus 100 may automatically operate a safety device such as a gas valve locking device or a power disconnection device so as to prevent the negligence accident or reduce additional damage. The acoustic event detecting apparatus 100 may use a smart home system for automatically operating the safety device. For example, when it is determined that a gas leakage accident has occurred after receiving an emergency alarm sound representing the gas leakage, the acoustic event detecting apparatus 100 may automatically operate the gas valve locking device to lock the gas valve in order to prevent additional damage due to the gas leakage.

As described above, when it is determined that an acoustic event has occurred, the acoustic event detecting apparatus 100 may transmit at least one of the sound, the image, and the moving picture obtained from outside to an external device so that a user of the external device may monitor a space where the acoustic event detecting apparatus 100 is located.

In addition, when it is determined that the acoustic event has occurred, the acoustic event detecting apparatus 100 of the present exemplary embodiment may transmit a control signal for controlling operations of the external device to the external device to notify the user of the occurrence of the acoustic event.

Figure 12:
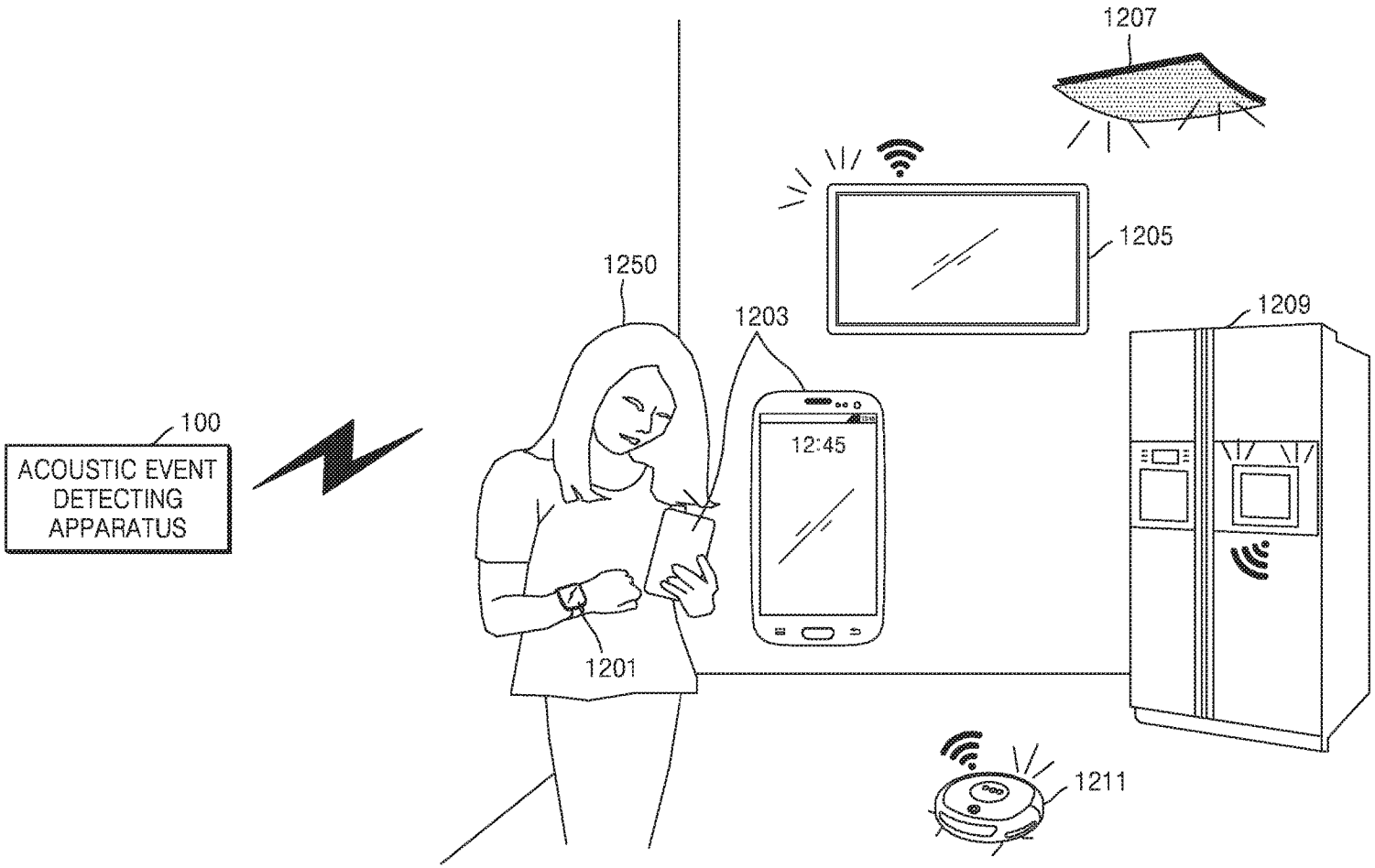
FIG. 12 is a diagram illustrating an acoustic event detecting apparatus according to an exemplary embodiment performing a controlling of an external device.

FIG. 12 is a diagram illustrating a method of controlling operations of the external device by the acoustic event detecting apparatus 100 according to an exemplary embodiment.

FIG. 12 shows a case where the acoustic event detecting apparatus 100 determines that the acoustic event has occurred.

The acoustic event detecting apparatus 100 may transmit a control signal to a portable terminal such as a smart watch 1201 that is a wrist watch capable of performing data communication or a smartphone 1203, for controlling the portable terminal to output a sound, an image, or vibration.

Otherwise, the acoustic event detecting apparatus 100 may transmit a control signal to the portable terminal for controlling a display unit of the portable terminal to output colors or lights.

Otherwise, the acoustic event detecting apparatus 100 may transmit a control signal to a home electronic appliance for controlling the home electronic appliance such as a TV 1205, a refrigerator 1209, or a robot vacuum cleaner 1211 to output a sound or an image. In addition, the home electronic appliance that may move, for example, the robot vacuum cleaner 1211, may move based on the control signal so as to notify a user 1250 of the occurrence of the acoustic event. Also, the acoustic event detecting apparatus 100 may transmit a control signal to the home electronic appliance for controlling a display unit in the home electronic appliance to output colors or lights.

Otherwise, the acoustic event detecting apparatus 100 may transmit a control signal to a lamp 1207 for controlling the lamp 1207 to flicker. The acoustic event detecting apparatus 100 may directly transmit the control signal to the external device including the home electronic appliance or the lamp, or may transmit the control signal to a control device controlling operations of the external device or a controller of a home network system.

Therefore, according to the acoustic event detecting apparatus 100 of the present exemplary embodiment, the user 1250 located in a different space from that of the acoustic event detecting apparatus 100 may be notified of the occurrence of the acoustic event. For example, if a baby is crying in a bedroom, the acoustic event detecting apparatus 100 may notify the user in a living room that the baby is crying by controlling operations of the external device located in the living room.

Figure 13:
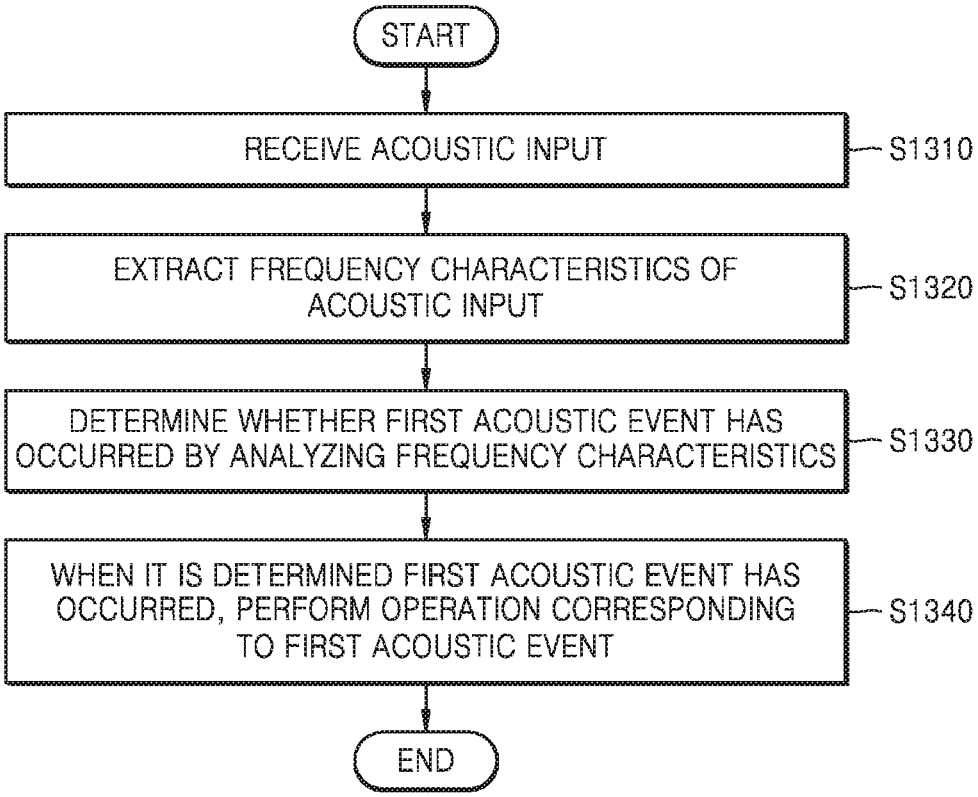
FIG. 13 is a flowchart illustrating a method of operating an acoustic event detecting apparatus, according to an exemplary embodiment.

FIG. 13 is a flowchart illustrating a method of operating the acoustic event detecting apparatus according to an exemplary embodiment. Operations S1310 through S1330 in FIG. 13 correspond to the operations S910 through S930 illustrated in FIG. 9, and thus, detailed descriptions thereof are omitted.

In operation S1310, the acoustic event detecting apparatus 100 according to the present exemplary embodiment may receive an acoustic input from outside of the acoustic event detecting apparatus 100.

In operation S1320, the acoustic event detecting apparatus 100 may extract frequency characteristics of the acoustic input.

In operation S1330, the acoustic event detecting apparatus 100 may determine whether a first acoustic event has occurred by analyzing the extracted frequency characteristics.

In operation S1340, the acoustic event detecting apparatus 100 may perform operations corresponding to the first acoustic event, when it is determined that the first acoustic event has occurred.

According to the present exemplary embodiment, the operations corresponding to the first acoustic event may include at least one of an operation of displaying a standby screen for suspending the operation of notifying the emergency state, an operation of acquiring a keyword mapped with the first acoustic event, an operation of switching to a notification mode corresponding to the first acoustic event, and an operation of displaying a standby screen for communicating with an external device that is designated in advance. Hereinafter, execution of operations corresponding to the acoustic event by the acoustic event detecting apparatus 100 will be described in more detail with reference to FIGS. 14 through 16.

When it is determined that an emergency state of the user has occurred, the acoustic event detecting apparatus 100 may transmit a signal representing the emergency state to a phone number that is registered in advance, for example, a number of a personal security system.

The acoustic event detecting apparatus 100 according to the present exemplary embodiment may determine that an acoustic event related to an emergency state has occurred by analyzing the acoustic input. The emergency state may include a case where the user of the acoustic event detecting apparatus 100 is threatened, a case where the user is robbed, and a case where a vehicle that the user drives is involved in an accident.

The acoustic event detecting apparatus 100 of the present exemplary embodiment may determine that an emergency state has occurred when detecting a screaming sound of the user, detecting an impact sound of a predetermined level or higher, or detecting voices of a person including predetermined words about an emergency.

When it is determined that the user of the acoustic event detecting apparatus 100 is in an emergency state, the acoustic event detecting apparatus 100 may display a standby screen corresponding to the acoustic event. The acoustic event detecting apparatus 100 may display a standby screen for stopping an operation of notifying the emergency state, when it is determined that an emergency state has occurred.

The acoustic event detecting apparatus 100 may not notify the emergency state instantly even when it is determined that the emergency state has occurred, but may maintain a transmission standby state for a predetermined time so as to prevent false notification of the emergency state caused by an error in detecting the acoustic event.

The acoustic event detecting apparatus 100 according to the present exemplary embodiment displays the standby screen, and after that, may perform operations of notifying the emergency state unless an input of the user for suspending the operation of notifying the emergency state is received within a predetermined time. In order to notify the emergency state, the acoustic event detecting apparatus 100 may transmit a message representing that the emergency state has occurred to an external device that is designated in advance. The external device that is designated in advance may be, for example, a device that may make a call to a friend of the user, the security office, or the police station. Also, the message representing that the emergency state has occurred may be a text message or a voice message.

The acoustic event detecting apparatus 100 according to the present exemplary embodiment may display the standby screen in order to wait for a predetermined time before transmitting information representing that the emergency state has occurred. The predetermined time may be, for example, about 5 seconds.

According to the present exemplary embodiment, the standby screen may be a screen that is totally irrelevant with the emergency state so that only the user may recognize that the standby screen relates to the emergency state notification.

The user of the acoustic event detecting apparatus 100 may input a user input for suspending the operation of notifying the emergency state while the acoustic event detecting apparatus 100 waits for the transmission of the information representing that the emergency state has occurred. For example, the user may input a preset password to suspend the operation of notifying the emergency state.

Also, the acoustic event detecting apparatus 100 may transmit data about at least one of a sound, an image, and a moving picture obtained from outside of the acoustic event detecting apparatus 100 to the external device so that a peripheral circumstance of the acoustic event detecting apparatus 100 may be monitored through the external device. Otherwise, the acoustic event detecting apparatus 100 may automatically operate a global positioning system (GPS) included in the acoustic event detecting apparatus 100 so as to transmit location information of the acoustic event detecting apparatus 100 to the external device. Also, the acoustic event detecting apparatus 100 may store data about at least one of the sound, the image, and the moving picture obtained from the outside in the storage 139.

Figure 14:
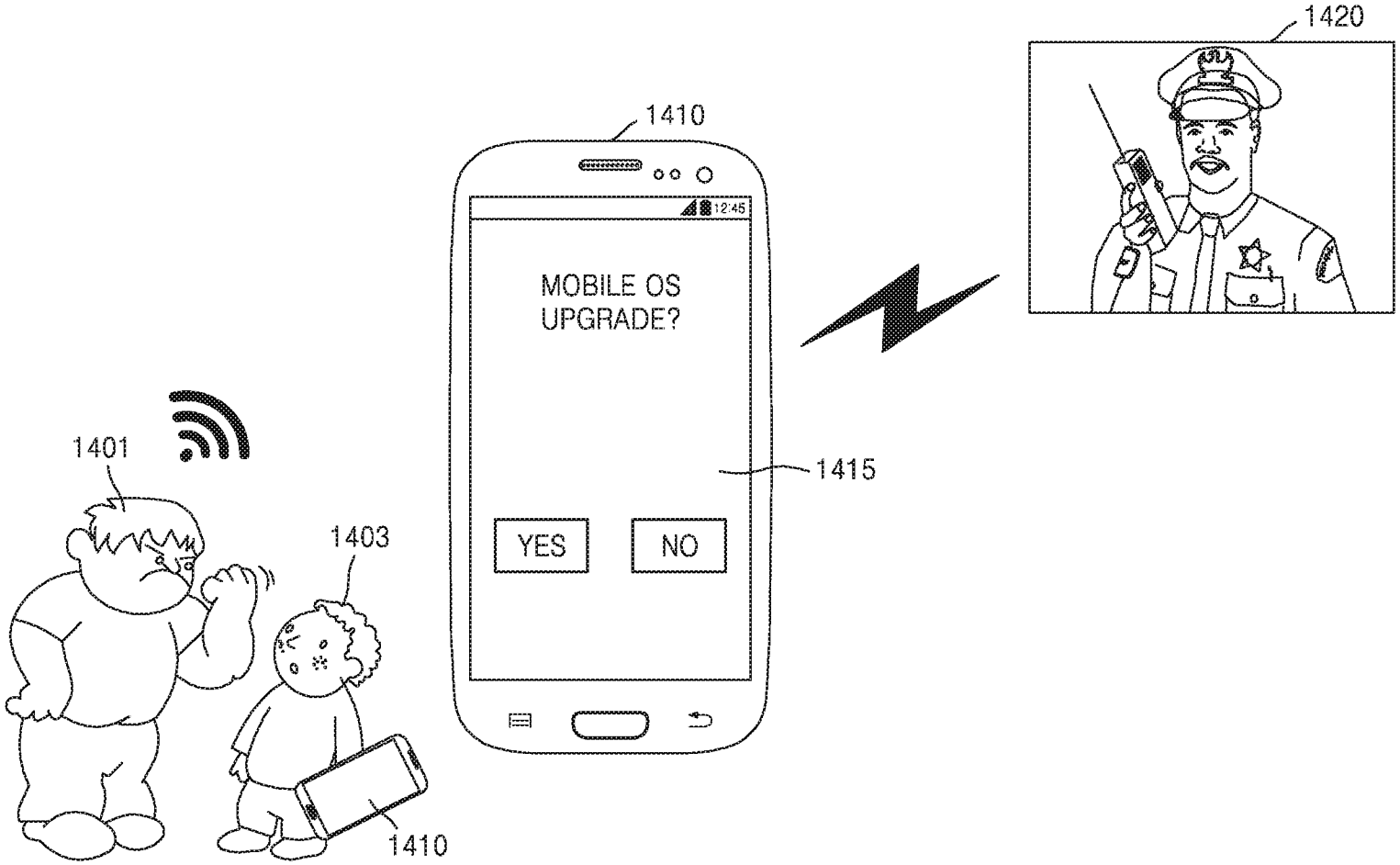
FIG. 14 is a diagram showing an example of a standby screen for terminating execution of an operation of notifying an emergency, according to an exemplary embodiment.

FIG. 14 shows an example of the standby screen for stopping the operation of notifying the emergency state, according to an exemplary embodiment. FIG. 14 shows a case where the acoustic event detecting apparatus 100 is included in a portable terminal; however, the exemplary embodiments are not limited thereto.

FIG. 14 shows an example where a user 1403 is threatened by a person 1401. In this case, the acoustic event detecting apparatus 1410 may determine that an emergency state has occurred when an impact sound generating when the person 1401 attacks the user 1403, a screaming sound of the user 1403, or voice of the person 1401 including predetermined words related to the threatening is received.

When determining that the emergency state has occurred, the acoustic event detecting apparatus 1410 may display a standby screen 1415 that looks irrelevant with the emergency state. The standby screen 1410 may be a screen that is not relevant with the emergency state and is provided so that only the user 1403 may recognize the standby screen 1415. A screen to be used as the standby screen 1415 may be determined according to a user input, that is, the standby screen 1415 may be changed by the user. For example, as shown in FIG. 14, a screen for selecting whether to upgrade a mobile operating system (OS) may be displayed as the standby screen 1415.

The acoustic event detecting apparatus 1410 may wait for a predetermined time after displaying the standby screen 1415 before transmitting the information for representing that the emergency state has occurred. The predetermined time may be, for example, about 5 seconds. The user 1403 may input a user input for stopping the operation of notifying the emergency state during the predetermined time. For example, the user 1403 may input the user input for stopping the operation of notifying the emergency state by touching the standby screen 1415.

If the user input for stopping the operation of notifying the emergency state is not received in the predetermined time, the acoustic event detecting apparatus 1410 may transmit a message representing the emergency state to a phone number that is designated in advance, for example, a police station 1420.

The acoustic event detecting apparatus 100 according to the present exemplary embodiment may be used in searching by providing search information corresponding to an acoustic event after detecting the acoustic event.

When it is determined that a predetermined acoustic event has occurred, the acoustic event detecting apparatus 100 of the present exemplary embodiment may acquire a keyword that is stored after being mapped with a predetermined acoustic event. The acoustic event detecting apparatus 100 may acquire information related to the keyword from the storage 139 of the acoustic event detecting apparatus 100 or an external server, and output the information.

For example, when receiving "bird singing sound", the acoustic event detecting apparatus 100 of the present exemplary embodiment may show the user an image related to a bird stored therein or may provide the user with contents such as an image or a moving picture including a bird by a searching operation through the Internet.

Figure 15:
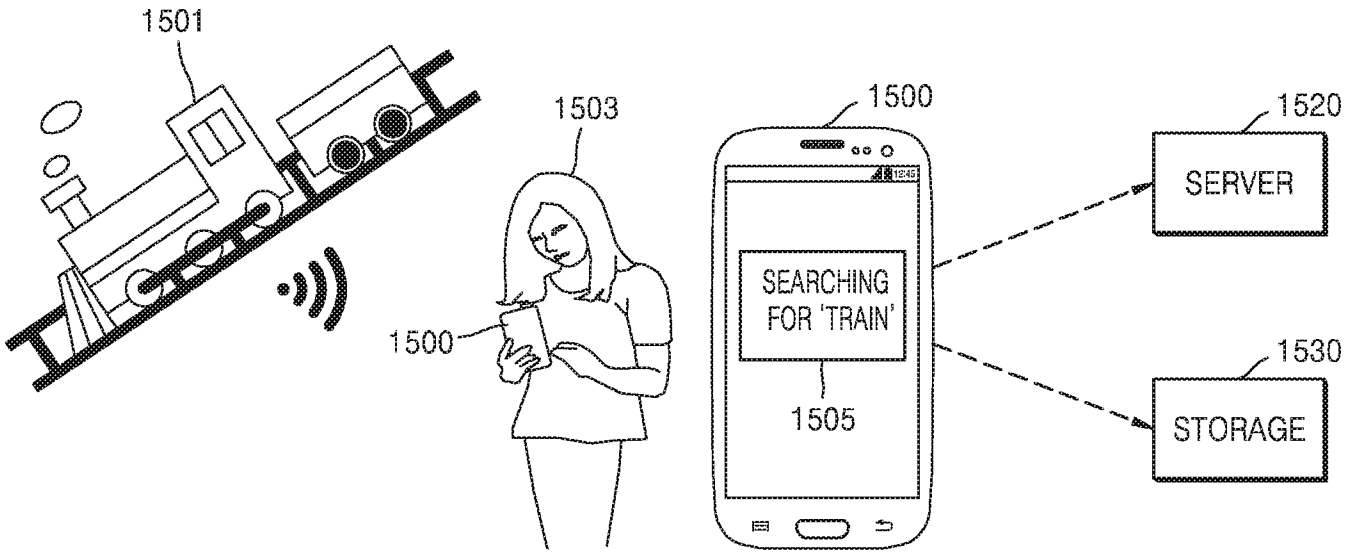
FIG. 15 is a diagram illustrating a method of providing learning information related to an acoustic event, according to an exemplary embodiment.

FIG. 15 is a diagram illustrating a method of providing search information related to an acoustic event according to an exemplary embodiment. FIG. 15 shows a case where the acoustic event detecting apparatus is included in a portable terminal as an example; however, the exemplary embodiments are not limited thereto.

FIG. 15 shows a case where an acoustic event detecting apparatus 1500 receives an acoustic input related to a train. The case where the acoustic input related to a train is received may include, for example, a case where the acoustic event detecting apparatus 1500 receives an acoustic input including a sound of a train 1501 passing by, or a case where the acoustic event detecting apparatus 1500 receives voice including a word "train" from a user 1503.

When determining that an acoustic event related to the train has occurred, the acoustic event detecting apparatus 1500 may acquire a keyword "train" that is mapped with an acoustic event related to the train and stored in a storage. The acoustic event detecting apparatus 1500 may search for information related to the keyword and provide the user 1503 with the information.

For example, the acoustic event detecting apparatus 1500 may search for at least one of a document, a sound, an image, and a moving picture related to the keyword stored in a storage 1530, and may output it on a screen 1505. The storage 1530 may be included in the acoustic event detecting apparatus 1500, or may be wired/wirelessly connected to the acoustic event detecting apparatus 1500.

Otherwise, the acoustic event detecting apparatus 1500 may transmit the keyword to an external server 1520 via Internet, and may receive contents related to the keyword, which are searched for by the external server. The contents transmitted from the external server may include at least one of the document, the sound, the image, and the moving picture. The acoustic event detecting apparatus 1500 may output the searched contents on the Internet on the screen 1505.

As described above, the acoustic event detecting apparatus 100 may search the storage of the acoustic event detecting apparatus 100 or the external server for the keyword related to the acoustic input as a searched object.

In addition, the acoustic event detecting apparatus 100 may search the storage of the acoustic event detecting apparatus 100 or the external server for the acoustic input itself as the searched objected, after receiving the acoustic input.

The acoustic event detecting apparatus 100 of the present exemplary embodiment may receive an acoustic input including a sigh, a crying sound, or a laughing sound of the user, and may detect an acoustic event related to an emotional status of the user.

The acoustic event detecting apparatus 100 according to the present exemplary embodiment may detect an acoustic event related to an emotional status of the user, and may provide the user with an image or a video corresponding to the detected acoustic event or may communicate with an external device that is designated in advance.

For example, the acoustic event detecting apparatus 100 may receive an acoustic input including a sigh of the user, and may determine that the user sighs. In this case, the acoustic event detecting apparatus 100 may perform a predetermined operation that is stored in advance for refreshing the user.

For example, a funny image, an image including a smiling face, a picture of the user as a child, etc. may be output through the screen. Also, the acoustic event detecting apparatus 100 may search for a video for refreshing the user in the Internet and provide the user with the video. Otherwise, a phone call standby screen may be output so that the user makes a call to a designated person who may console the user.

As another example, the acoustic event detecting apparatus 100 may receive an acoustic input including a laughing sound of the user, and then, may determine that the user laughs. In this case, the acoustic event detecting apparatus 100 may provide the user with an image or a video that may please the user so that the user may feel even better. Otherwise, a phone call standby screen may be output so that the user makes a call to a designated person who may share the user's joy.

Figure 16:
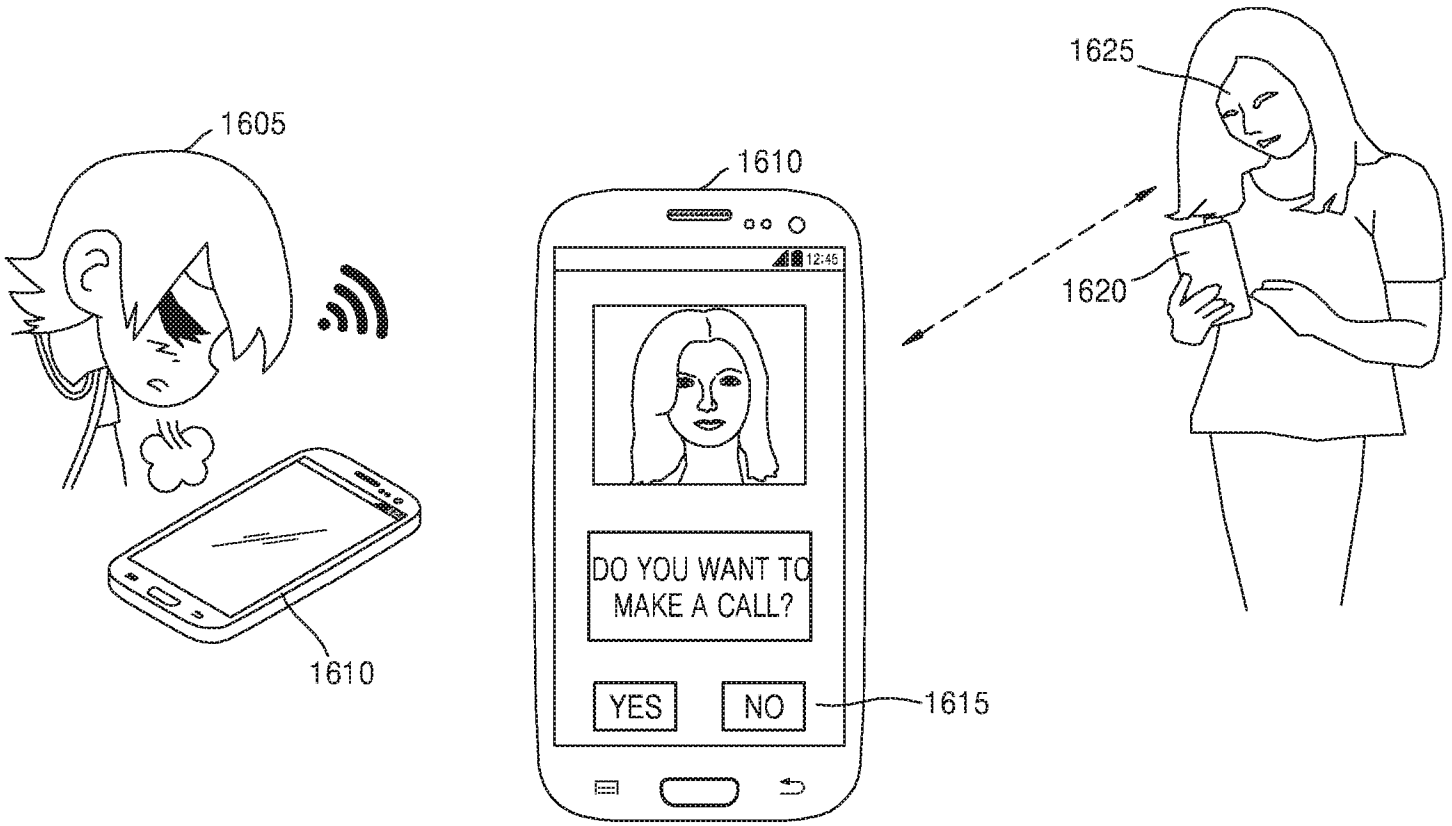
FIG. 16 is a diagram illustrating a method of communicating with an external device designated in advance, according to an exemplary embodiment.

FIG. 16 is a conceptual diagram illustrating a method of communicating with an external device that is designated in advance, according to an exemplary embodiment. FIG. 16 shows a case where the acoustic event detecting apparatus is included in a portable terminal as an example; however, the exemplary embodiments are not limited thereto.

As shown in FIG. 16, when a user 1605 sighs, the acoustic event detecting apparatus 1610 may make a phone call to an external device 1620 of a person 1625 corresponding to a phone number that is designated in advance. Otherwise, the acoustic event detecting apparatus 1610 may display a standby screen 1615 for making a call, and makes the call when receiving a user command for making the call from the user 1605.

The acoustic event detecting apparatus 100 according to an exemplary embodiment may be included in the portable terminal. In this case, the acoustic event detecting apparatus 100 may detect at least one acoustic event, and then, may recognize peripheral circumstances according to the detected acoustic event and change characteristics of an alarm sound of the portable terminal or a sound of a phone call through the portable terminal. The characteristics of the alarm sound or the sound of a phone call may include a volume or frequency characteristics of the alarm sound or the sound of a phone call. The alarm sound may denote a sound output to notify the user of receiving of a phone call, receiving of a text message, or a push notification of an application installed on the portable terminal. The sound of a phone call may denote a sound that the user hears when the user makes a phone call via the portable terminal.

The acoustic event detecting apparatus 100 analyzes acoustic characteristics of a peripheral circumstance of the acoustic event detecting apparatus 100, and accordingly, may change the alarm sound characteristic or frequency characteristics of a call receiving sound of the portable terminal including the acoustic event detecting apparatus 100. Also, the acoustic event detecting apparatus 100 may analyze the acoustic characteristics of the peripheral circumstance in further consideration of GPS information or an identity (ID) of a mobile communication cell in which the acoustic event detecting apparatus 100 is located.

Also, the acoustic event detecting apparatus 100 may set a notification mode corresponding to the acoustic event. Setting of the notification mode may include selecting one notification mode corresponding to the acoustic event from among a plurality of notification modes, and operating the acoustic event detecting apparatus 100 in the selected notification mode. The notification mode may include at least one of a bell ringing mode, a vibration mode, and a mute mode.

For example, the acoustic event detecting apparatus 100 may change the frequency characteristics of the alarm sound according to the acoustic characteristic of the peripheral circumstance while maintaining the alarm sound of the portable terminal. The acoustic event detecting apparatus 100 may change the frequency characteristics of the alarm sound according to the acoustic characteristics of the peripheral circumstance or a space where the acoustic event detecting apparatus 100 is located, so that the user may easily recognize the alarm sound.

As another example, the acoustic event detecting apparatus 100 may change a notification mode in which the portable terminal operates, according to the acoustic characteristics of the peripheral circumstance. For example, when the acoustic event detecting apparatus 100 determines that the portable terminal is in a subway after analyzing the acoustic characteristics of the peripheral circumstance, the acoustic event detecting apparatus 100 may change the notification mode of the portable terminal to a vibration mode. Otherwise, when the acoustic event detecting apparatus 100 determines that the portable terminal is in a theater after analyzing the acoustic characteristics of the peripheral circumstance, the acoustic event detecting apparatus 100 may change the notification mode of the portable terminal to a mute mode. Otherwise, the acoustic event detecting apparatus 100 may select a ringing sound that the user may suitably recognize from among a plurality of ringing sounds according to the acoustic characteristics of the peripheral circumstance, and may change the notification mode to a bell ringing mode of the selected ringing sound.

As another example, the acoustic event detecting apparatus 100 may change call sound characteristics according to acoustic characteristics of the peripheral circumstance. The acoustic event detecting apparatus 100 may change the call sound characteristics to be distinguished from peripheral noise, and thus, clarity of the call sound may be improved.

The acoustic event detecting apparatus 100 according to the present exemplary embodiment may gradually notify the user that an acoustic event has occurred, based on the detected acoustic event.

Figure 17:
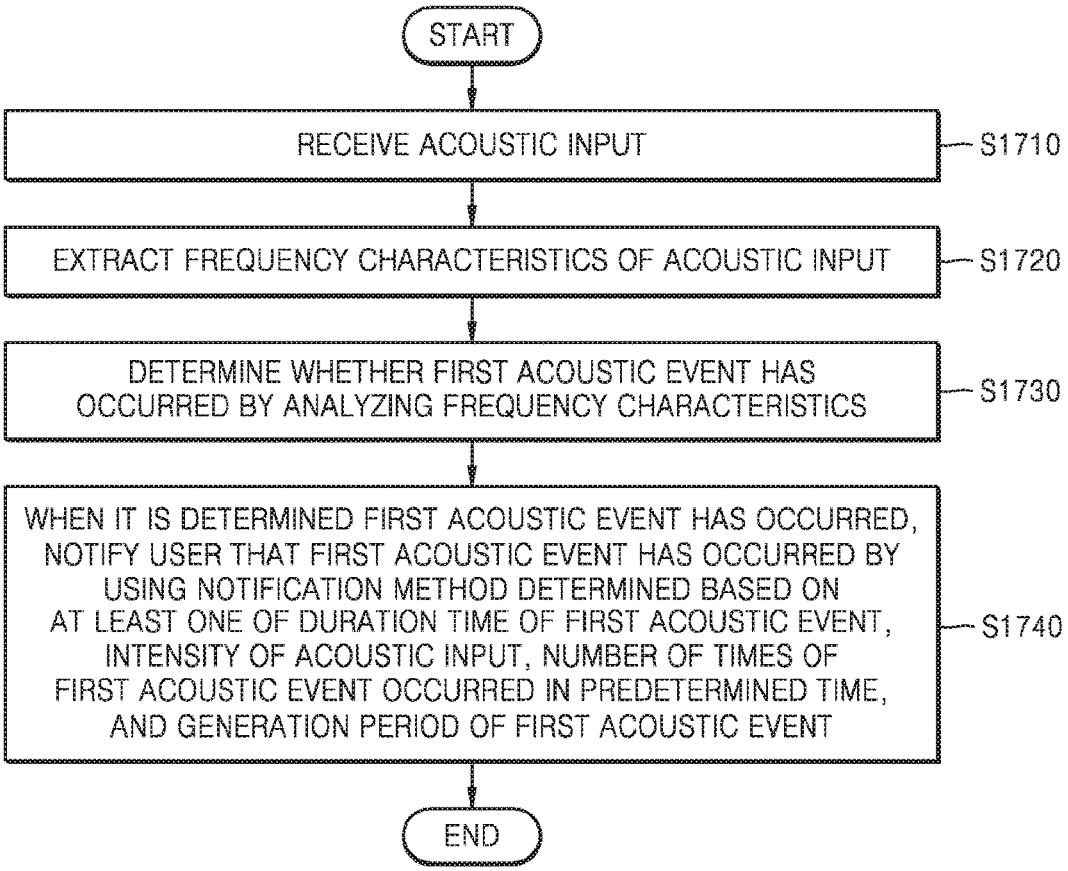
FIG. 17 is a flowchart illustrating a method of operating an acoustic event detecting apparatus according to an exemplary embodiment.

FIG. 17 is a flowchart illustrating a method of operating the acoustic event detecting apparatus 100 according to an exemplary embodiment. Operations S1710 through S1730 in FIG. 17 correspond to the operations S510 through S530 in FIG. 5, and thus, detailed descriptions thereof are not provided.

In operation S1710, the acoustic event detecting apparatus 100 of the present exemplary embodiment may receive an acoustic input from outside of the acoustic event detecting apparatus 100.

In operation S1720, the acoustic event detecting apparatus 100 may extract frequency characteristics of the acoustic input.

In operation S1730, the acoustic event detecting apparatus 100 of the present exemplary embodiment may analyze the frequency characteristics to determine whether a first acoustic event has occurred.

In operation S1740, when it is determined that the first acoustic event has occurred, the acoustic event detecting apparatus 100 may notify the user of the occurrence of the acoustic event by using a notification method determined based on at least one of a duration time of the first acoustic event, an intensity of the acoustic input, a frequency of the first acoustic event during a predetermined time period, and a generation period of the first acoustic event. Also, the acoustic event detecting apparatus 100 may determine the notification method based on an intensity of a frequency component related to the first acoustic event included in the acoustic input, as well as the intensity of the acoustic input. The acoustic event detecting apparatus 100 may use a plurality of notification methods to which a plurality of ranks are allocated. When it is determined that the first acoustic event has occurred, the acoustic event detecting apparatus 100 may notify the user of the occurrence of the first acoustic event by using a first notification method. In at least one of the cases where a duration time of the first acoustic event increases, where the intensity of the acoustic input increases, the number of occurrences of the first acoustic events for a predetermined time period increases, and a generation period of the first acoustic event is reduced, the acoustic event detecting apparatus 100 may notify the user of the occurrence of the first acoustic event by using a notification method at the next rank of the first notification method with the first notification method.

A case where the acoustic event detecting apparatus 100 detects sound of a car horn as a first acoustic event will be described as an example. In this case, if the car horn sound continues for a few seconds or longer, if the car horn sound becomes greater than a predetermined level, if the car horn sound occurs a few times or more for a few seconds, or if the occurrence period between the car horn sounds becomes a predetermined period or shorter, the acoustic event detecting apparatus 100 may notify the user of the car horn sound by using a notification method of a next rank.

A case where the acoustic event detecting apparatus 100 determines the notification method based on the duration time of the first acoustic event will be described below. In this case, when it is determined that the first acoustic event has occurred, the acoustic event detecting apparatus 100 may notify the user of the occurrence of the first acoustic event by using a first notification method. When the first acoustic event continues for a first time period or longer, the acoustic event detecting apparatus 100 may notify the user of the occurrence of the first acoustic event by using the first notification method and a second notification method. If the first acoustic event continues for a second time period or longer, the acoustic event detecting apparatus 100 may notify the user of the occurrence of the first acoustic event by using the first notification method, the second notification method, and a third notification method.

The acoustic event detecting apparatus 100 may notify the user of the occurrence of the first acoustic event by displaying an image related to the first acoustic event on the screen, generating alarm sound or vibration, or stopping the execution of an application program that is in use.

If the user uses the portable terminal with earphones, the user may not easily hear the external sound, and thus, an accident due to the negligence of the user may occur. Therefore, the acoustic event detecting apparatus 100 of the present exemplary embodiment detects the acoustic event of the peripheral circumference, which may be a danger to the user, and gradually warns the user about the acoustic event to prevent generation of the accident due to the negligence of the user.

In addition, if a visually impaired person uses a portable terminal with earphones, it may be very dangerous since the visually impaired person may only recognize peripheral circumstances by hearing. Therefore, the acoustic event detecting apparatus 100 of the present exemplary embodiment may detect an acoustic event from the peripheral circumstances in a case where the visually impaired person uses the portable terminal with the earphones, and provides the user with the information about the detected acoustic event to prevent the occurrence of an accident.

Figure 18:
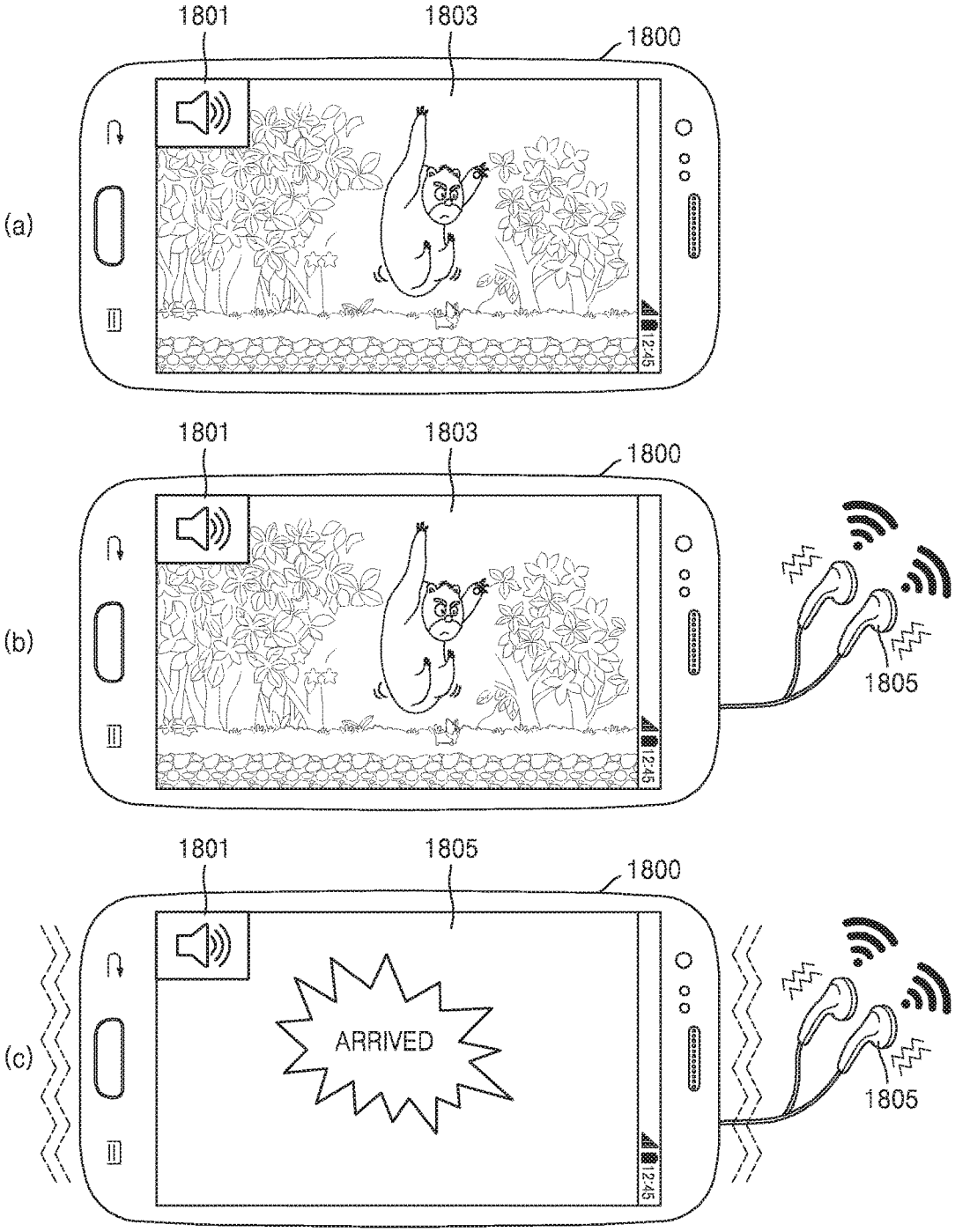
FIG. 18 is a diagram illustrating a method of notifying a user of occurrence of an acoustic event by a gradual alarm, according to an exemplary embodiment.

FIG. 18 is diagrams illustrating a method of notifying the user of the occurrence of the acoustic event through gradual notification processes. FIG. 18 shows a case where the acoustic event detecting apparatus according to the present exemplary embodiment is included in a portable terminal as an example; however, the exemplary embodiments are not limited thereto.

As shown in FIG. 18(*a*), if an acoustic event related to an emergency status is detected, an acoustic event detecting apparatus 1800 may display a predetermined icon 1801 on an upper end portion of a screen. The acoustic event related to the emergency status may include a case of receiving a car horn sound, or a case of receiving a fire alarm sound. The predetermined icon 1801 displayed on the upper end of the screen may be sufficiently small so as not to obscure a significant portion of the screen 1803 when the user watches the screen 1403.

As shown in FIG. 18(*b*), if the acoustic event related to the emergency status continues for a first time (for example, about two seconds) or longer, the acoustic event detecting apparatus 1800 may output a warning sound through earphones 1805. Here, the icon 1801 may be continuously displayed on the upper end of the screen 1803. Also, the acoustic event detecting apparatus 1800 may vibrate the earphones 1805 to notify the user of the occurrence of the acoustic event related to the emergency status.

As shown in FIG. 18(*c*), if the acoustic event related to the emergency status continues for a second time (for example, about four seconds) or longer, the acoustic event detecting apparatus 1800 may stop operations of all application programs that are currently be executed. The acoustic event detecting apparatus 1800 may display a large pop-up window 1805 for notifying the user of the occurrence of the acoustic event. The large pop-up window 1805 may be formed in various types, and may be displayed in various displaying ways, for example, the large pop-up window 1805 may flicker. Also, the acoustic event detecting apparatus 1800 may notify the user of the occurrence of the acoustic event related to the emergency status by outputting vibration. Here, the icon 1801 may be continuously displayed on the upper end of the screen 1803, and the warning sound or the vibration may be continuously output through the earphones 1805.

The acoustic event detecting apparatus 100 according to the present exemplary embodiment may gradually notify the user the acoustic event according to emergency of the acoustic event so that the user may appropriately deal with the emergency status, and thus, convenience of using the acoustic event detecting apparatus 100 may be improved.

However, in public transportation such as subways or buses, it is difficult to detect a location of the acoustic event detecting apparatus 100 in real-time due to the poor accuracy of a location detecting system such as a GPS. Therefore, the acoustic event detecting apparatus 100 according to the present exemplary embodiment may be used in a location detecting system by analyzing acoustic characteristics of peripheral circumstances.

The acoustic event detecting apparatus 100 of the present exemplary embodiment may be used in a destination notification system that notifies the user in the public transport of the destination, by considering an announcement for announcing every stop.

Figure 19:
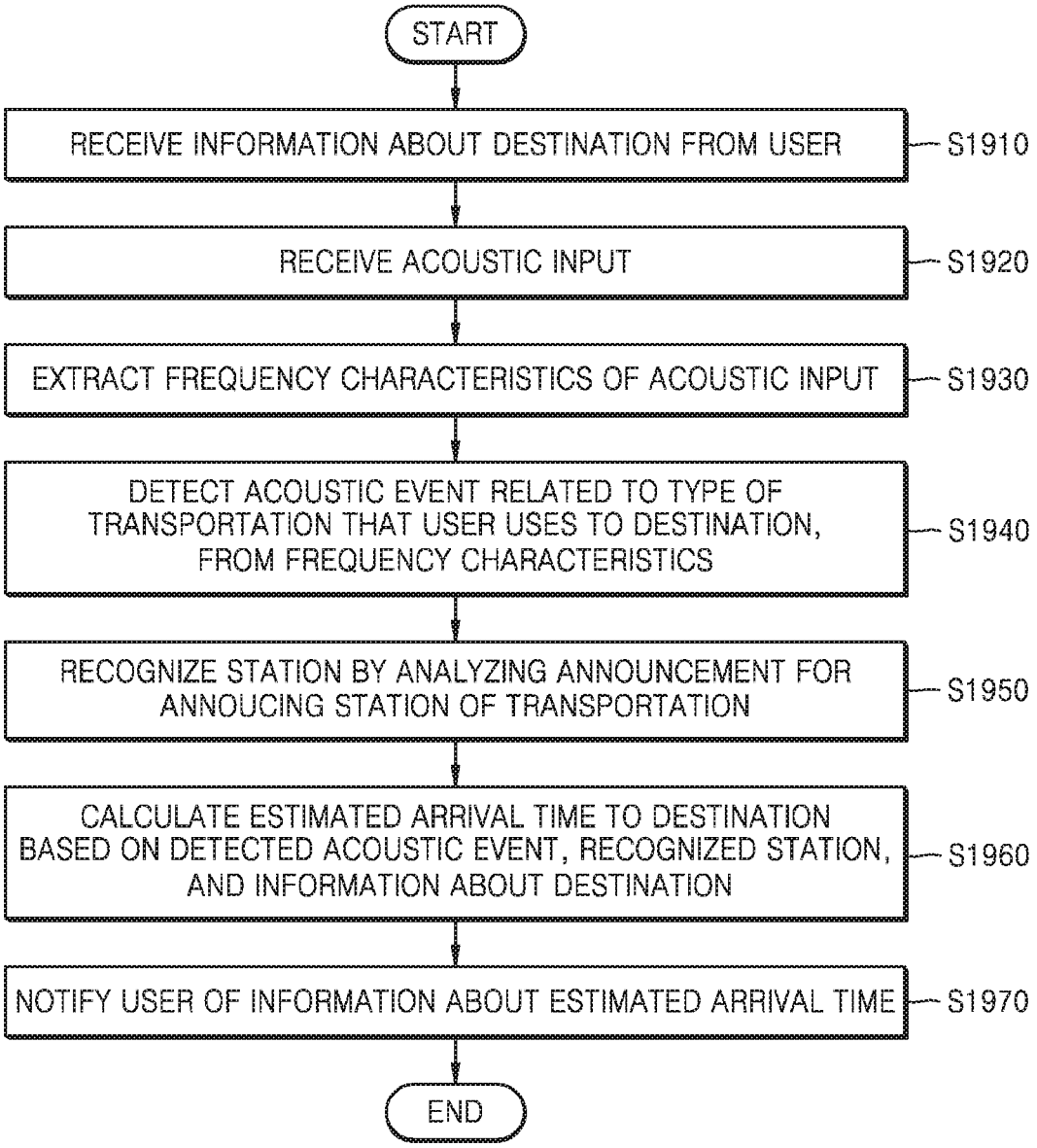
FIG. 19 is a flowchart illustrating a method of operating an acoustic event detecting apparatus according to an exemplary embodiment.

FIG. 19 is a flowchart illustrating a method of operating an acoustic event detecting apparatus 100 according to an exemplary embodiment. Operations S1920 through S1940 in FIG. 19 correspond to the operations S910 through S930 of FIG. 9, and thus, detailed descriptions thereof are not provided.

In operation S1910, the acoustic event detecting apparatus 100 may receive information about a destination from the user. The information about the destination may include information about a bus stop or a subway station that the user wants to travel to, or location information of the destination such as address of the destination.

In operation S1920, the acoustic event detecting apparatus 100 may receive an acoustic input from outside of the acoustic event detecting apparatus 100.

In operation S1930, the acoustic event detecting apparatus 100 may extract frequency characteristics of the acoustic input.

In operation S1930, the acoustic event detecting apparatus 100 may detect a predetermined acoustic event by analyzing the extracted frequency characteristics. The acoustic event detecting apparatus 100 may detect an acoustic event that is related to a type of the transportation that the user uses to travel to the destination. For example, the user may ride a bus or a subway in order to reach the destination. For example, a first reference signal may include an acoustic input related to the type of transportation that the user uses to travel to the destination. The acoustic input related to the type of the transportation may include at least one of a sound of an announcement of a station, a sound of opening doors, and a sound of closing doors.

In operation S1950, the acoustic event detecting apparatus 100 may recognize the station by analyzing the announcement of the transportation. The acoustic event detecting apparatus 100 may recognize the announcement through a voice recognition function, by activating the voice recognition function based on the detected acoustic event. For example, when the sound starting the announcement is detected by using the acoustic event detecting method according to exemplary embodiments, the acoustic event detecting apparatus 100 may recognize next station by performing the voice recognition function of the announcement.

In operation S1960, the acoustic event detecting apparatus 100 may calculate an estimated time to the destination, based on the acoustic event detected from the peripheral noise, the station recognized through the announcement, and the information about the destination input by the user. For example, when it is determined that the user is traveling to the destination by subway, the acoustic event detecting apparatus 100 may calculate an estimated time to the destination in consideration of a subway map stored therein in advance.

The acoustic event detecting apparatus 100 may determine the transportation used by the user to travel to the destination by analyzing the peripheral noise. Also, the acoustic event detecting apparatus 100 may determine a location of the acoustic event detecting apparatus 100 based on the detected acoustic event, and the station recognized from the announcement. For example, when the acoustic event detecting apparatus 100 detects the sound starting the announcement, the acoustic event detecting apparatus 100 may activate the voice recognition function to recognize that the announcement announces that the next station is "central station." After recognizing that the next station is the "central station," when the acoustic event detecting apparatus 100 detects the sound of opening doors, the acoustic event detecting apparatus 100 may recognize that the transportation in which the acoustic event detecting apparatus 100 is located, is currently stopped central station. Therefore, the acoustic event detecting apparatus 100 may calculate an estimated time to travel to the destination based on the information about the destination input by the user and the current location.

In operation S1970, the acoustic event detecting apparatus 100 may notify the user of the information about the estimated time to the destination. For example, if the estimated time is equal to or less than a predetermined time, the acoustic event detecting apparatus 100 may notify the user that the destination is near. The predetermined time may be set by the user.

The acoustic event detecting apparatus 100 may notify the user that the destination is near by using a notification method based on the estimated arrival time. The acoustic event detecting apparatus 100 may notify the user of the shortened estimated arrival time by using the gradual notification methods discussed above, as the estimated arrival time is reduced.

For example, the method of notifying the user that the arrival time to the destination is near may include the method described above with reference to FIGS. 13 and 14. Accordingly, detailed descriptions are not provided here.

The acoustic event detecting apparatus 100 may notify the user that the arrival time to the destination is near by outputting characters or images on a screen or outputting a notification sound or vibration, in consideration of information about the destination received from the user, the transportation that the user uses to travel to the destination, a line map corresponding to the transportation (e.g., a subway map), announcement about stations, and acoustic events representing the peripheral circumstances.

In particular, a case where the user goes to the destination by subway will be described as follows. The acoustic event detecting apparatus 100 may recognize that the user travels to the destination by subway by detecting acoustic events related to the subway. When the user inputs the destination, the acoustic event detecting apparatus 100 recognizes a location of the user by recognizing the peripheral noise in the subway and the announcements in the subway. The acoustic event detecting apparatus 100 may notify the user of a distance to the destination or an estimated arrival time in consideration of the current location of the user.

Figure 20:
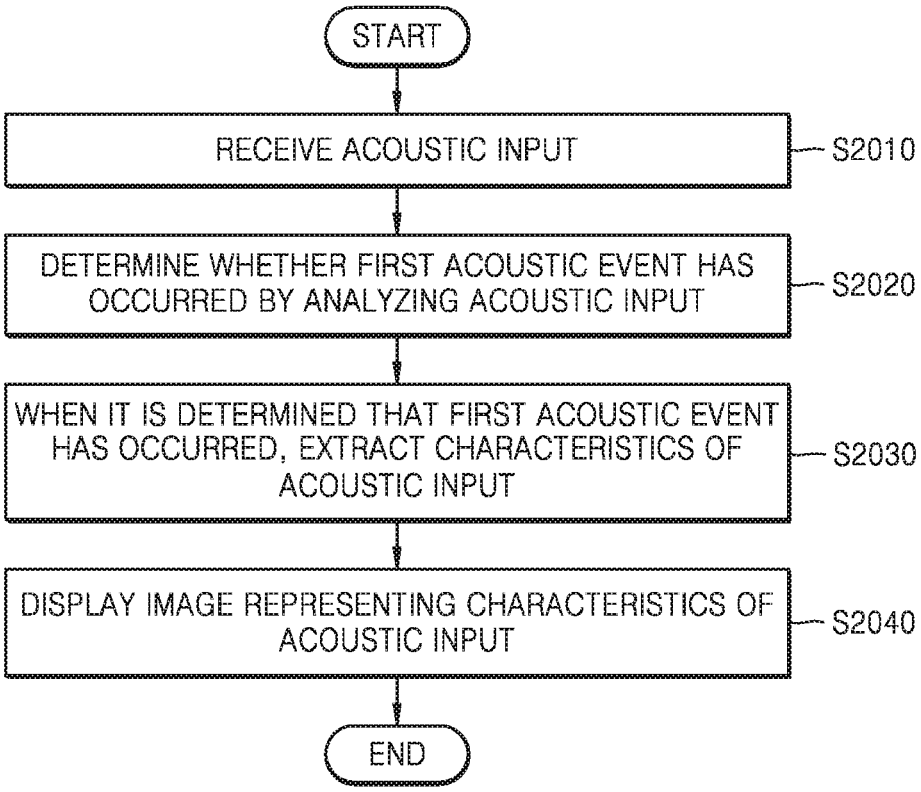
FIG. 20 is a flowchart illustrating a method of operating an acoustic event detecting apparatus according to an exemplary embodiment.

FIG. 20 is a flowchart illustrating a method of operating the acoustic event detecting apparatus, according to an exemplary embodiment.

Operation S2010 to operation S2020 illustrated in FIG. 20 correspond to operations S910 to S930 of FIG. 9, and thus, descriptions thereof are omitted.

In operation S2010, the acoustic event detecting apparatus 100 according to the exemplary embodiment may receive an acoustic input from the outside the acoustic event detecting apparatus 100.

In operation S2020, the acoustic event detecting apparatus 100 according to the exemplary embodiment analyzes the acoustic input to determine whether a first acoustic event has occurred. For example, the acoustic event detecting apparatus 100 according to the exemplary embodiment extracts the frequency characteristic of the acoustic input, and analyzes the extracted frequency characteristic to determine whether the first acoustic event has occurred.

When it is determined that the first acoustic event has occurred in operation S2020, the acoustic event detecting apparatus 100 according to the exemplary embodiment may extract characteristics of the acoustic input in operation S2030.

For example, the acoustic event detecting apparatus 100 may extract at least one of the first acoustic event that is determined to occur based on the acoustic input, a type of the first acoustic event, a location where the first acoustic event has occurred, a direction of receiving the acoustic input, a magnitude of the acoustic input, and a frequency characteristic of the acoustic input as the characteristic of the acoustic input.

The acoustic event detecting apparatus 100 according to the exemplary embodiment receives the acoustic input via a beacon having a microphone built therein so as to extract the at least one of the direction of receiving the acoustic input and the location where the first acoustic event has occurred as the characteristic of the acoustic input. The beacon is a small-sized device that is capable of performing wireless communication, and transmits/receives a certain signal (e.g., light, sound, color, electric wave, etc.) to provide a device communicating with the beacon with information that may determine the location and direction of the device.

The acoustic event detecting apparatus 100 according to the exemplary embodiment receives the acoustic input via the beacon, and accordingly, the acoustic event detecting apparatus may clearly receive an acoustic input from a far distance and may easily identify the location where the acoustic event has occurred.

For example, the beacon having the microphone built therein may be located at a place where a certain acoustic event frequency occurs or a place where the target sound may be received loud. In this case, when an acoustic input is received through a certain beacon and it is determined that the first acoustic event has occurred by analyzing the acoustic input, the acoustic event detecting apparatus 100 may identify that the first acoustic event has occurred adjacent to the corresponding beacon.

Therefore, the acoustic event detecting apparatus 100 according to the exemplary embodiment receives the acoustic inputs via the beacons that are placed at different locations that are already known, and thus, may identify where a certain acoustic event has occurred.

Figure 21:
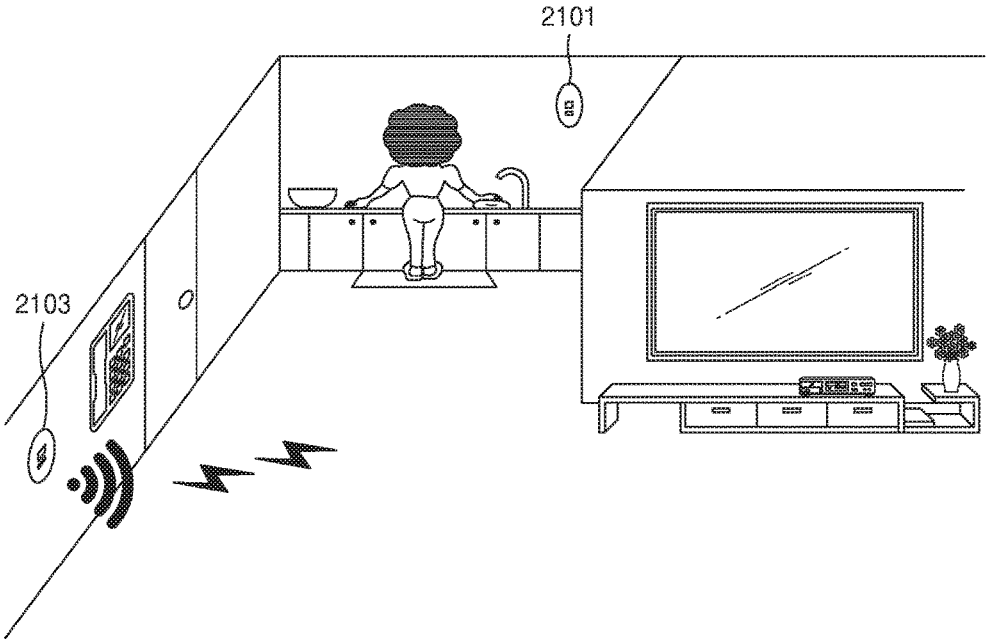
FIG. 21 is a diagram illustrating a method of receiving an acoustic input by using a beacon, according to an exemplary embodiment.

FIG. 21 is a diagram illustrating a method of receiving an acoustic input via a beacon according to an exemplary embodiment.

The beacon having a microphone built therein may be located at a place where a certain acoustic event frequently occurs or a place where the target sound relating to the acoustic event is received loud, in a house. For example, as shown in FIG. 21, a beacon 2101 may be provided around a gas valve lockout or a power disconnector. In this case, when an alarm sound is received through the beacon 2101, the acoustic event detecting apparatus 100 may determine that an acoustic event has occurred adjacent to the beacon 2101.

Otherwise, as shown in FIG. 21, a beacon 2103 may be provided around an interphone from which doorbell ringing sound frequently outputs. In this case, when a doorbell ringing sound is received through the beacon 2101, the acoustic event detecting apparatus 100 according to the exemplary embodiment may determine that an acoustic event has occurred around the beacon 2101.

In operation S2040, the acoustic event detecting apparatus 100 according to the exemplary embodiment may display an image representing the characteristic of the acoustic input.

The acoustic event detecting apparatus 100 may notify the user of an occurrence of the acoustic event, and at the same time, may provide the user with information about the location where the acoustic event has occurred.

Figure 22:
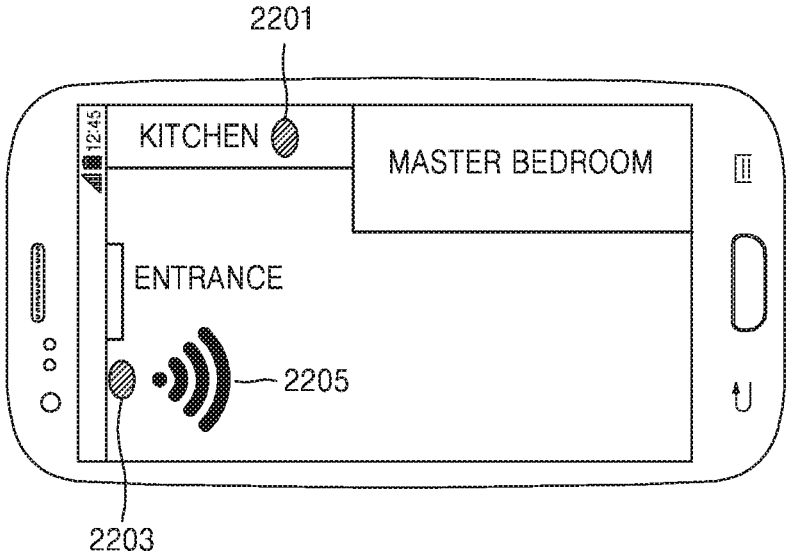
FIG. 22 is a diagram showing an example of a screen for notifying occurrence of an acoustic event, according to an exemplary embodiment.

FIG. 22 is a diagram showing an example of a screen for notifying occurrence of the acoustic event, according to the exemplary embodiment. As shown in FIG. 22, the acoustic event detecting apparatus 100 may display an image including icons 2201 and 2203 representing locations where the beacons are provided in the house, via a TV, a mobile phone, or other IT devices. The acoustic event detecting apparatus 100 may display an image including an icon 2205 representing a location where the acoustic event has occurred or a direction of receiving the acoustic input.

In addition, the acoustic event detecting apparatus 100 according to the exemplary embodiment may display an image representing at least one of a type of sound generated by a predetermined acoustic event, an intensity of the sound, a frequency characteristic of the sound, and a direction of the sound, after detecting the predetermined acoustic event. The acoustic event detecting apparatus 100 may display an image representing the characteristic of the acoustic input via the outputter 137 included in the acoustic event detecting apparatus 100. Otherwise, the acoustic event detecting apparatus 100 may transmit the image representing the characteristic of the acoustic input to an external device via the communicator 131 included in the acoustic event detecting apparatus 100. The image transmitted to the external device may be displayed by the external device.

Figure 23:
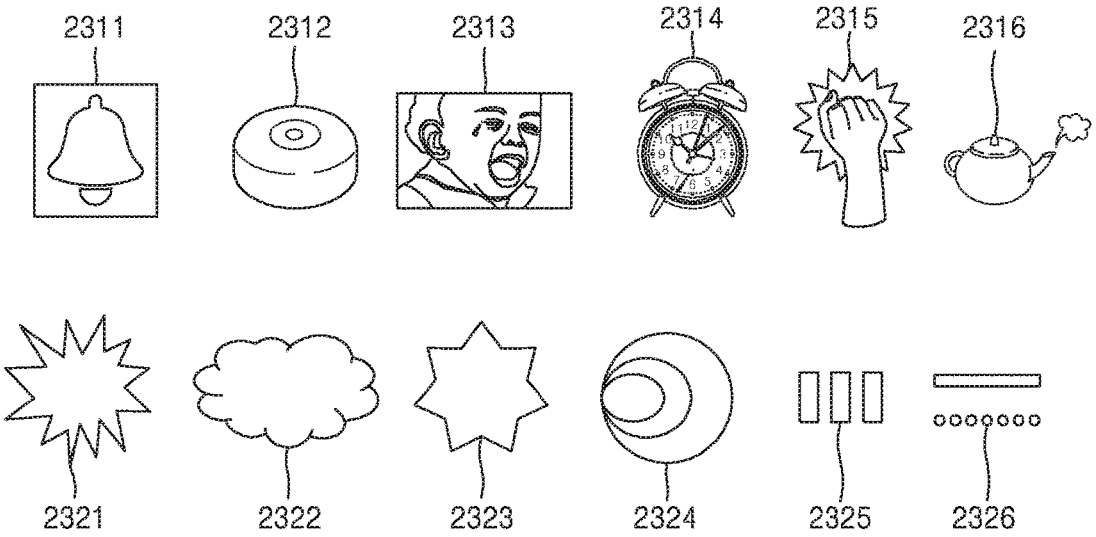
FIG. 23 is a diagram illustrating examples of icons representing characteristics of an acoustic input, according to an exemplary embodiment.

FIG. 23 shows examples of an icon representing the characteristic of the acoustic input, according to the exemplary embodiment.

The acoustic event detecting apparatus 100 may display an image including an icon or a character representing the characteristic of the acoustic event.

In FIG. 23, icons 2311 to 2316 represent detected acoustic events. For example, the icon 2311 may represent that the doorbell rings. The icon 2312 may represent that a fire alarm rings. The icon 2313 may represent that a baby is crying. The icon 2314 may represent that an alarm rings. The icon 2315 may represent that there is a knocking sound. The icon 2316 may represent that a kettle whistles.

In addition, icons 2321 to 2326 shown in FIG. 23 denote frequency characteristics of the acoustic input, from which the acoustic event is detected. For example, the icon 2311 denotes that a sharp sound has occurred. The icon 2321 denotes that a soft sound has occurred. The icon 2323 may denote that a dull sound has occurred. The icon 2324 may denote an echo sound has occurred. The icon 2325 may denote that a certain sound repeatedly occurs with a constant time interval. The icon 2326 may denote that a predetermined sound is generated continuously.

Figure 24:
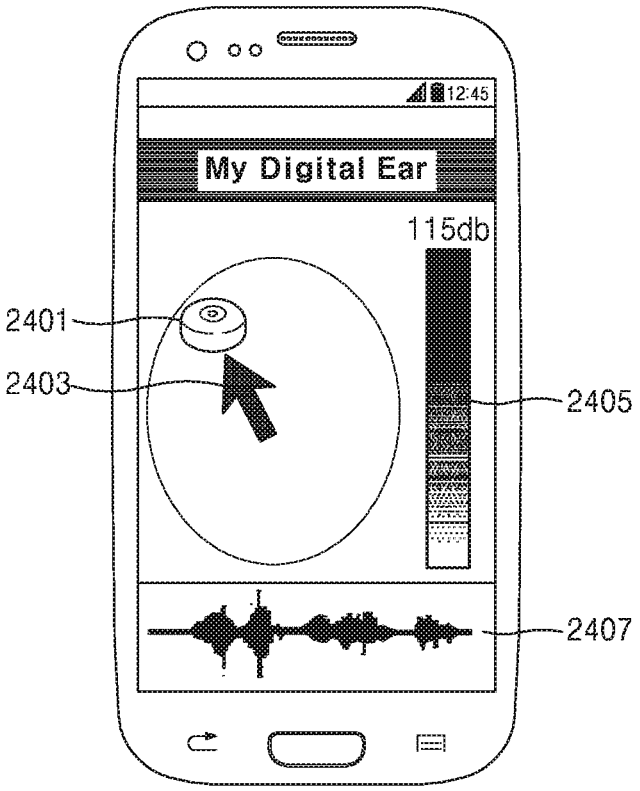
FIG. 24 is a diagram showing an example of a screen on which an image representing characteristics of an acoustic input is displayed, according to an exemplary embodiment.

FIG. 24 is a diagram illustrating an example of a screen displaying an image representing the characteristic of the acoustic input, according to the exemplary embodiment.

The acoustic event detecting apparatus 100 according to the exemplary embodiment may display a type, a direction, and a magnitude of the acoustic input. As shown in FIG. 24, the image representing the characteristic of the acoustic input according to the exemplary embodiment may include an icon 2401 representing the type of the detected acoustic event, an icon 2403 representing a location where the acoustic event has occurred or a direction of receiving sound generated by the acoustic event, an image 2405 representing a magnitude of the acoustic input, and an image 2407 representing a waveform of the acoustic input.

The acoustic event detecting apparatus 100 according to the exemplary embodiment may express a volume of the sound that is currently generating in at least one of a color, a height of a bar, and a number, by analyzing the acoustic input. In addition, the acoustic event detecting apparatus 100 according to the exemplary embodiment may display an image showing a waveform from a point when the acoustic input has generated due to the acoustic event is received to a point when the acoustic input has finished. The acoustic event detecting apparatus 100 according to the exemplary embodiment may notify the user of the occurrence of the acoustic event through vibrations from when receiving the acoustic input generated due to the acoustic event until when the receiving of the acoustic input is finished.

In addition, the acoustic event detecting apparatus 100 may be used to improve convenience of a hearing-impaired person in everyday life by providing information about an acoustic event using notification methods other than those outputting sound. In order for the acoustic event detecting apparatus 100 to provide the user with the information about the acoustic event in a notification method other than the method of outputting sound, the method described with reference to FIG. 8 may be used. Accordingly, detailed descriptions thereof are not provided.

The acoustic event detecting apparatus 100 may be included in a home electronic appliance or a portable terminal.

If a guardian of a baby is a hearing-impaired person, the guardian may not recognize the baby crying and an accident may occur.

The acoustic event detecting apparatus 100 of the present exemplary embodiment may detect the baby crying sound via a microphone included in the home electronic appliance or the portable terminal. When detecting the baby crying sound, the acoustic event detecting apparatus 100 may output a screen representing that the baby is crying, output vibration, or may output colors or lights through the portable terminal of the guardian. Otherwise, as shown in FIG. 8, the acoustic event detecting apparatus 100 may provide information about the acoustic event through the home electronic appliance using notification methods other than the method of outputting sound.

Also, a hearing-impaired person may not recognize an emergency alarm sound representing an accident such as a gas leakage or a fire, siren sound of a police car, or a gun-shot sound. Thus, the hearing-impaired person is likely to be in danger because he/she does not recognize the accident.

When detecting an emergency alarm sound notifying the user of an accident such as a gas leakage or a fire, the acoustic event detecting apparatus 100 of the present exemplary embodiment may provide the user with information about the acoustic event using notification methods other than the method of outputting sound. The acoustic event detecting apparatus 100 may provide information about a type of the acoustic event that has occurred.

Also, the acoustic event detecting apparatus 100 may analyze acoustic inputs received through a plurality of microphones to further provide information about an orientation from which the acoustic event has occurred.

In addition, the acoustic event detecting apparatus 100 may notify the user of the emergency, and at the same time, the acoustic event detecting apparatus 100 may automatically operate a safety device such as a gas valve blocking device or a power disconnection device so as to prevent an accident or to reduce additional damage.

The acoustic event detecting apparatus 100 may use a smart home system in order to automatically operate the safety device. For example, when it is determined that a gas leakage accident has occurred after receiving an emergency alarm sound representing the gas leakage, the acoustic event detecting apparatus 100 may block a gas valve by operating the gas valve blocking device, and thereby prevent damage caused by the gas leakage.

Also, the hearing-impaired person may not recognize a doorbell ringing sound or a door knocking sound. Thus, the hearing-impaired person may be inconvenienced because he/she may not recognize visiting of strangers.

When receiving an acoustic input including the doorbell ringing sound or the door knocking sound, the acoustic event detecting apparatus 100 of the present exemplary embodiment may determine that an acoustic event related to the visiting of a stranger has occurred based on the acoustic input. The acoustic event detecting apparatus 100 may provide the user with information about the acoustic event in other notification methods than the method of outputting sound.

An exemplary embodiment may also be realized in a form of a computer-readable recording medium, such as a program module executed by a computer. A computer-readable recording medium may be an arbitrary available medium accessible by a computer, and examples thereof include all volatile and non-volatile media and separable and non-separable media. Further, examples of the computer-readable recording medium may include a computer storage medium and a communication medium. Examples of the computer storage medium include all volatile and non-volatile media and separable and non-separable media, which have been implemented by an arbitrary method or technology, for storing information such as computer-readable commands, data structures, program modules, and other data. The communication medium typically includes a computer-readable command, a data structure, a program module, other data of a modulated data signal, or another transmission mechanism, and an example thereof includes an arbitrary information transmission medium.

It should be understood that the exemplary embodiments described therein should be considered in a descriptive sense only and not for purposes of limitation. Descriptions of features or aspects within each exemplary embodiment should typically be considered as available for other similar features or aspects in other exemplary embodiments.

While one or more exemplary embodiments have been described with reference to the drawings, it will be understood by those of ordinary skill in the art that various changes in form and details may be made therein without departing from the spirit and scope of the inventive concept as defined by the following claims.

The invention claimed is:

1. A method of operating an acoustic event detecting apparatus, the method comprising:

extracting frequency characteristics of an acoustic input;

determining whether a first acoustic event has occurred by analyzing the extracted frequency characteristics;

in response to determining that the first acoustic event has occurred, acquiring at least one of an image and a video from an environment outside of the acoustic event detecting apparatus; and transmitting the acquired at least one of the image and the video to a first device, wherein the first acoustic event is an event in which a sound is generated, and is classified by at least one of a type of sound source generating the sound and a characteristic of the generated sound, and wherein the determining whether the first acoustic event has occurred comprises:

operating in a multi-acoustic event detection (multi-AED) mode or a simple acoustic event detection (simple-AED) mode based on whether the environment outside of the acoustic event detecting apparatus is an environment where overlapping acoustic events occur.

2. The method of claim 1, further comprising transmitting, to a second device, a control signal for controlling the second device, in response to determining that the first acoustic event has occurred.

3. The method of claim 2, wherein the first device is a portable terminal, and wherein the second device includes at least one of a home electronic appliance and a gas or power disconnecting device.

4. The method of claim 1, wherein the method further comprises outputting at least one of a sound, an image, and a video, which corresponds to the first acoustic event, in response to determining that the first acoustic event has occurred.

5. A non-transitory computer-readable recording medium having embodied thereon a program, which when executed by a computer, performs the method according to claim 1.

6. An acoustic event detecting apparatus comprising:

a receiver configured to receive an acoustic input;

a sound processor configured to extract frequency characteristics of the acoustic input and determine whether a first acoustic event has occurred by analyzing the extracted frequency characteristics;

a data acquirer configured to acquire at least one of an image and a video from an environment outside of the acoustic event detecting apparatus, in response to determining that the first acoustic event has occurred; and a communicator configured to transmit the acquired at least one of the image and the video to a first device, wherein the first acoustic event is an event in which a sound is generated, and is classified by at least one of a type of sound source generating the sound and a characteristic of the generated sound, and wherein the sound processor is further configured to operate in a multi-acoustic event detection (multi-AED) mode or a simple acoustic event detection (simple-AED) mode based on whether the environment outside of the acoustic event detecting apparatus is an environment where overlapping acoustic events occur.

7. The acoustic event detecting apparatus of claim 6, wherein the communicator is further configured to transmit a control signal for controlling a second device to the second device, in response to determining that the first acoustic event has occurred.

8. The acoustic event detecting apparatus of claim 7, wherein the first device is a portable terminal, and wherein the second device includes at least one of a home electronic appliance, and a gas or power disconnecting device.

9. The acoustic event detecting apparatus of claim 6, further comprising an outputter configured to output at least one of a sound, an image, and a video, which corresponds to the first acoustic event, in response to determining that the first acoustic event has occurred.

* * * * *